US006286934B1

(12) United States Patent
Sakanobe et al.

(10) Patent No.: US 6,286,934 B1
(45) Date of Patent: Sep. 11, 2001

(54) INK JET PRINTER INCLUDING DETACHABLE PRINT CARTRIDGE

(75) Inventors: Minoru Sakanobe, Komaki; Naohisa Kinoshita; Takamitsu Kawai, both of Nagoya; Masaki Takatsugi, Toyohashi, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/159,627

(22) Filed: Sep. 24, 1998

(30) Foreign Application Priority Data

| | | |
|---|---|---|
| Sep. 26, 1997 | (JP) | 9-261460 |
| Nov. 5, 1997 | (JP) | 9-302481 |
| Nov. 5, 1997 | (JP) | 9-302482 |
| Jun. 25, 1998 | (JP) | 10-178504 |

(51) Int. Cl.[7] ..... B41J 2/175
(52) U.S. Cl. ..... 347/49; 347/85
(58) Field of Search ..... 347/7, 33, 85, 347/86, 87

(56) References Cited

U.S. PATENT DOCUMENTS

| | | | | |
|---|---|---|---|---|
| 4,306,245 | | 12/1981 | Kasugayama et al. | 347/33 |
| 5,367,328 | * | 11/1994 | Erickson | 347/7 |
| 5,798,777 | * | 8/1998 | Yoshimura et al. | 347/44 |

FOREIGN PATENT DOCUMENTS

| | | |
|---|---|---|
| B2-62-42792 | 9/1987 | (JP) . |
| B2-5-218 | 1/1993 | (JP) . |
| A-6-234209 | 8/1994 | (JP) . |

* cited by examiner

*Primary Examiner*—N. Le
*Assistant Examiner*—Anh T. N. Vo
(74) *Attorney, Agent, or Firm*—Oliff & Berridge, PLC.

(57) ABSTRACT

A printer cartridge stationarily fixes an ink package and movably provides a print head, and a separate printer body movably provides a carriage. Prior to mounting of the printer cartridge onto the printer body, the print head is held at a fixed position of the printer cartridge by a pressing member. Because the print head is pressed downward by the pressing member, mounting the cartridge onto the printer body will insert the print head into the carriage. After the print head is inserted into the carriage, a pawl and a protrusion of the carriage fit into an engagement groove and an indentation, respectively, in the print head. Also another protrusions of the print head are supported on an upper edge of the carriage. As a result, the print head is mounted onto the carriage in association with mounting of the print cartridge onto the printer body. A printer cartridge has a retaining member formed with an engaging groove, and the print head has a rectangular protrusion. When the printer cartridge is detached from the printer body, the rectangular protrusion is trapped by the upwardly moving retaining member and is engaged with the engaging groove. Thus, the print head is automatically disengaged from the carriage in interlocking relation with detachment of the printer cartridge from the printer body.

30 Claims, 13 Drawing Sheets

(w=100 μm)

| THE OUTER DIAMETER d OF THE INK EXTRACTING MEMBER [mm] | 0.7 | 1.2 | 1.6 | 3 | 5 | 6 |
|---|---|---|---|---|---|---|
| THE PRESSING POWER F [gf] | 15 | 24 | 45 | 53 | 89 | 120 |

INK JET PRINTER INCLUDING DETACHABLE PRINT CARTRIDGE

BACKGROUND OF THE INVENTION

The present invention relates to an image forming device and a cartridge unit capable of preventing different colored inks from mixing when exchanging a cartridge unit filled with one colored ink with that filled with another colored ink and capable of reducing load imparted on a driving means for driving a print head.

There has been known an ink jet type print device having a print head. Ink is supplied to the print head from an ink-filled ink cartridge. The print head ejects the ink onto a print sheet in order to print characters and the like. A variety of configurations are known for supplying ink from a cartridge to a print head. For example, Japanese Patent Application Publication (Kokai) HEI-5-218 discloses an ink cartridge connected by an ink supply tube to a print head, which is mounted on a carriage of a printing device. Ink filling the ink cartridge is supplied through the ink supply tube to the print head.

However, with this configuration, when the ink cartridge in this printing device is to be exchanged for a new one, ink from the old ink cartridge can remain in the ink supply tube and in the print head when the new cartridge is exchanged. When an ink cartridge filled with one color of ink is replaced with an ink cartridge filled with a different color of ink, then the ink remaining in the ink supply tube and the print head can undesirably mix with the ink in the new ink cartridge. For example, if the ink cartridge presently mounted on the carriage is filled with black ink and the ink cartridge to replace the present ink cartridge is filled with magenta colored ink, then the black ink remaining in the ink supply tube and the print head can mix into the newly supplied magenta colored ink and change the color of the magenta colored ink.

Japanese Patent Publication (Kokoku) SHO-62-42792 discloses a print head cartridge configured from an integral print head and ink tank. A printing device using this print head cartridge can print in a desired color when a print head cartridge filled with a desired colored ink is mounted onto the carriage of the printing device. Further, when the print head cartridge is exchanged, the print head is also exchanged, so undesirable mixing of different colored inks can be prevented.

Since the print head cartridge includes not only the print head but also the ink tank, the load weight on the carriage includes not only the print head but also the ink tank. Therefore, the carriage motor for driving the carriage must be large enough to also move the weight of the ink tank, thereby requiring a large carriage motor. Further, a large amount of power is used for driving the carriage motor.

Further, as the ink stored in the ink tank is consumed during printing operations, the load on the carriage drops. As a result, the load imparted on the carriage motor fluctuates over time. When the load on the carriage motor fluctuates, the moving speed of the carriage also fluctuates so that it is difficult to obtain uniform and proper printing quality. As a result, there is a need to provide a separate control means for controlling moving speed of the carriage in association with change in the amount of ink in the ink tank. This special control device increases the production costs of the printing device.

Japanese Patent Application Publication (Kokai) HEI-6-234209 discloses a printing device having a print head and an ink tank connected together by an ink supply tube. The print head and ink tank form a unit that can be exchanged by detaching the unit from the main body of the printing device. The ink tank is fixed to a predetermined position of the unit, and only the print head is mounted on the carriage of the printing device.

Therefore, even when the ink in the ink tank is consumed during printing operations, load on the carriage will remain the same. For this reason, load on the carriage motor will also remain stable so that uniform and proper printing quality can be achieved. Further, printing can be performed in the desired colored ink by mounting a unit, including an ink tank filled with a desired colored ink, onto the main body of the printing device. By exchanging the unit, the print head is also exchanged so that undesirable mixing of different colored inks can be prevented.

SUMMARY OF THE INVENTION

However, with the exchangeable unit disclosed in Japanese Patent Application Publication (Kokai) HEI-6-234209, the print head must be grasped by fingers for its attachment to or detachment from the carriage. This makes exchanging the unit very troublesome. Further, because the user must grasp the print head by hand when detaching the print head from the carriage, the user may touch the nozzles of the print head, the user can stain his or her hands with ink.

It is, therefore an object of the present invention to overcome the above-described problems and to provide an image forming device and a cartridge unit capable of preventing undesirable mixture of ink when cartridge units for different colored inks are used, and capable of reducing the load imparted on the driving means for driving the print head, and enabling replacement of the print head on the carriage with a simple mounting operation.

These and other object of the present invention will be attained by providing an image forming device for forming an image on a print sheet including a printer body, a cartridge unit, a print head, a colored agent supply means, a carriage, driving means, and assisting means. The cartridge unit is detachably provided to the printer body. The print head impinges a colored agent onto the print sheet to print on the print sheet. The print head is slidably movably disposed in the cartridge unit. The colored agent supply means supplies colored agent to the print head. The supply means is disposed at a fixed position in the cartridge unit. The carriage is provided in the printer body and is reciprocally movable therein. The print head is detachably mounted on the carriage and is movable in accordance with the reciprocal movement of the carriage. The driving means is disposed in the printer body and drives the carriage. The assisting means assists mounting of the print head onto the carriage in interlocking relation with mounting of the cartridge unit onto the printer body.

In another aspect of the invention, there is provided an image forming device for forming an image on a print sheet including the printer body, the cartridge unit, the print head, the colored agent supply means, the carriage, the driving means, and a print head detachment means. The print head detachment means is adapted for detaching the print head from the carriage in interlocking relation with detachment of the cartridge unit from the printer body.

In still another aspect of the invention, there is provided an image forming device for forming an image on a print sheet including the printer body, the cartridge unit, the print head, the colored agent supply means, the carriage, the driving means, the assisting means, and the print head detachment means.

In still another aspect of the invention, there is provided a cartridge unit for use in combination with an image forming device, the image forming device having a printer body and a carriage reciprocally movably disposed therein, the cartridge unit including a cartridge case, a print head, a colored agent supply means, and assisting means. The cartridge case is detachably mountable to the printer body. The print head impinges a colored agent onto a print sheet to print on the print sheet. The print head is detachably mountable to the carriage and reciprocally movable in the cartridge case. The colored agent supply means supplies colored agent to the print head. The colored agent supply means is disposed at a predetermined position on the cartridge case. The assisting means assists mounting of the print head onto the carriage in interlocking relation with mounting of the cartridge unit onto the printer body.

In still another aspect of the invention, there is provided a cartridge unit for use in combination with an image forming device, the image forming device having a printer body and a carriage reciprocally movably disposed therein, the cartridge unit including the cartridge case, the print head, the colored agent supply means, and a print head detachment means. The print head detachment means is adapted for detaching the print head from the carriage in interlocking relation with detachment of the cartridge unit from the printer body.

In still another aspect of the invention, there is provided a cartridge unit for use in combination with an image forming device, the image forming device having a printer body and a carriage reciprocally movably disposed therein, the cartridge unit including the cartridge case, the print head, the colored agent supply means, the assisting means, and the print head detachment means.

Figure 1:
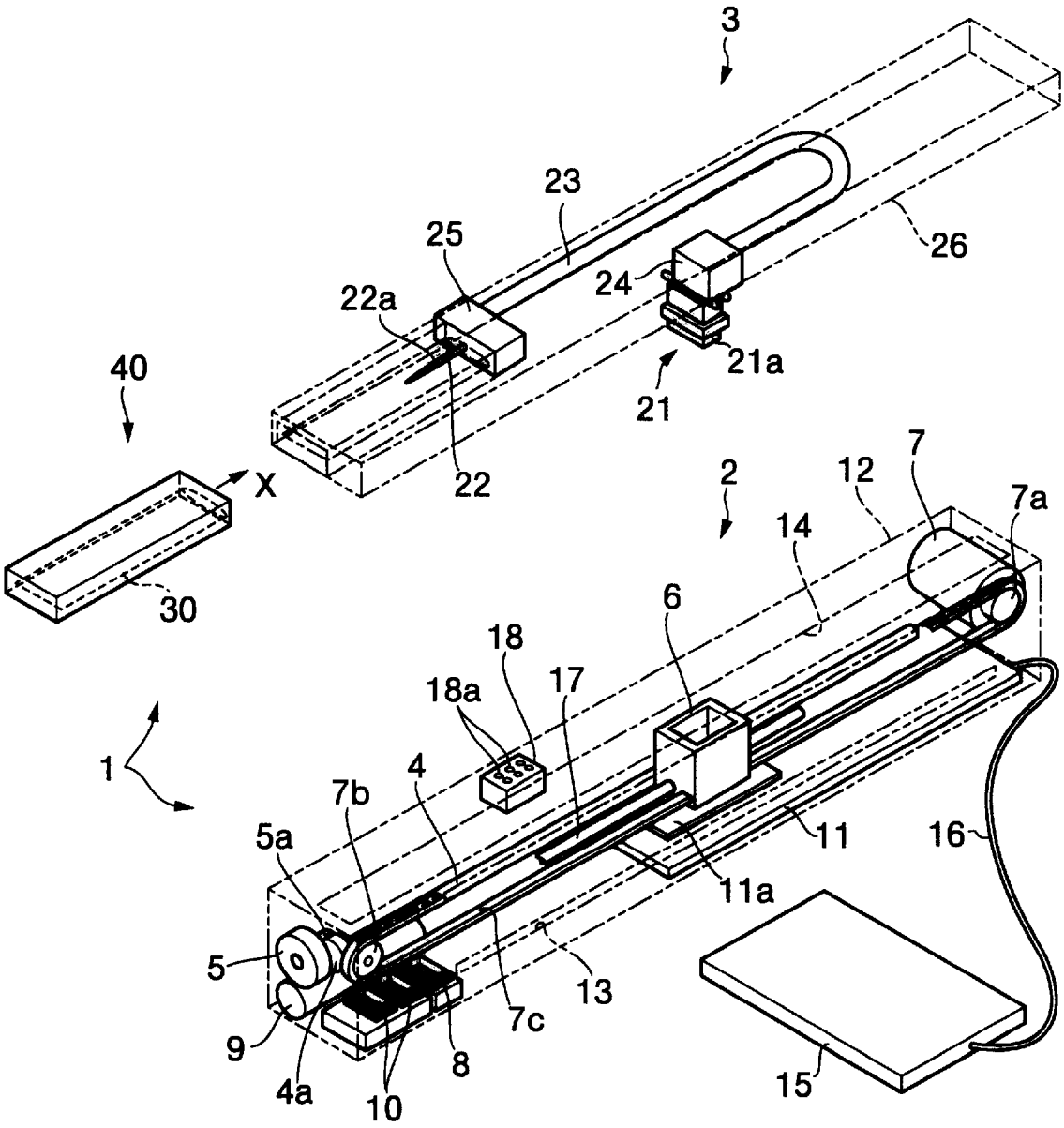
FIG. 1 is an exploded perspective view showing an ink jet printer including a printer cartridge according to a first embodiment of the present invention.
Figure 4:
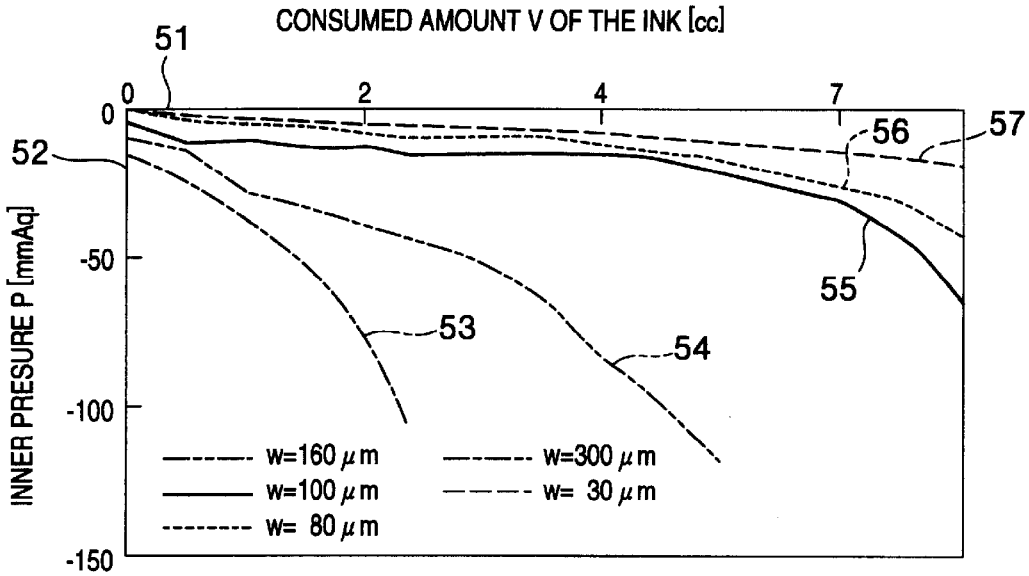
Figure 5:
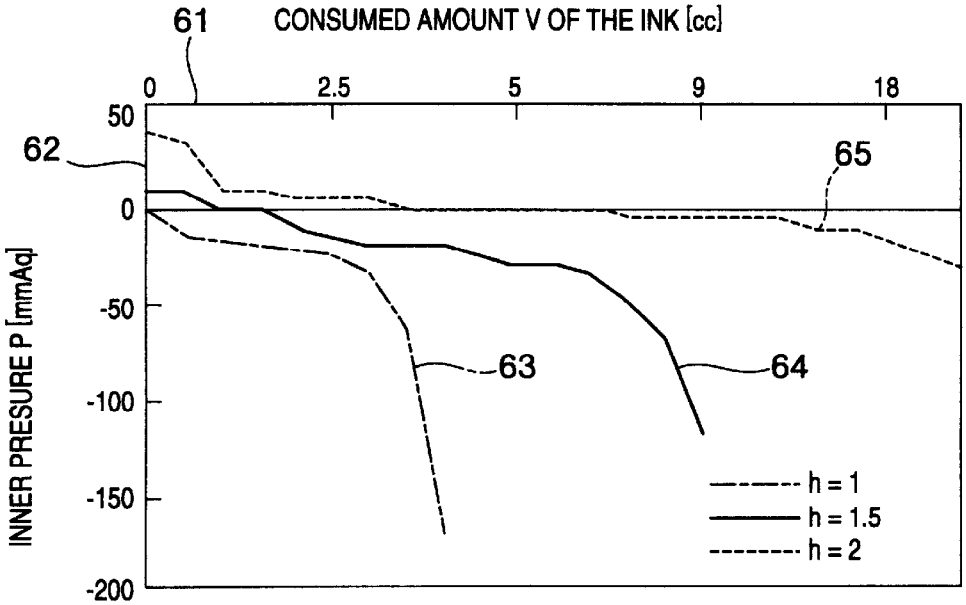
Figures 6, 7:
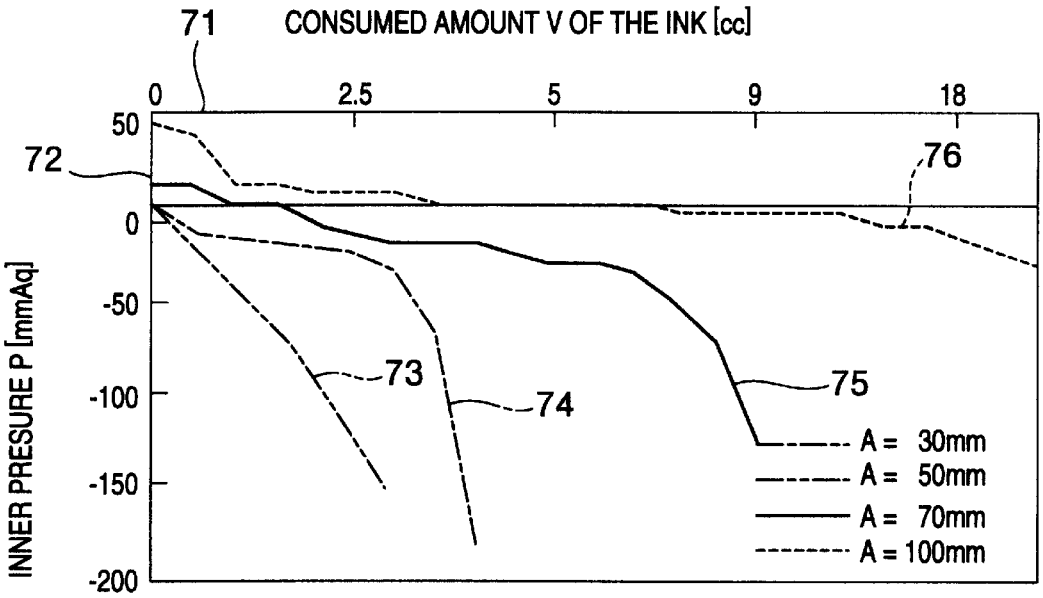
Figure 8:
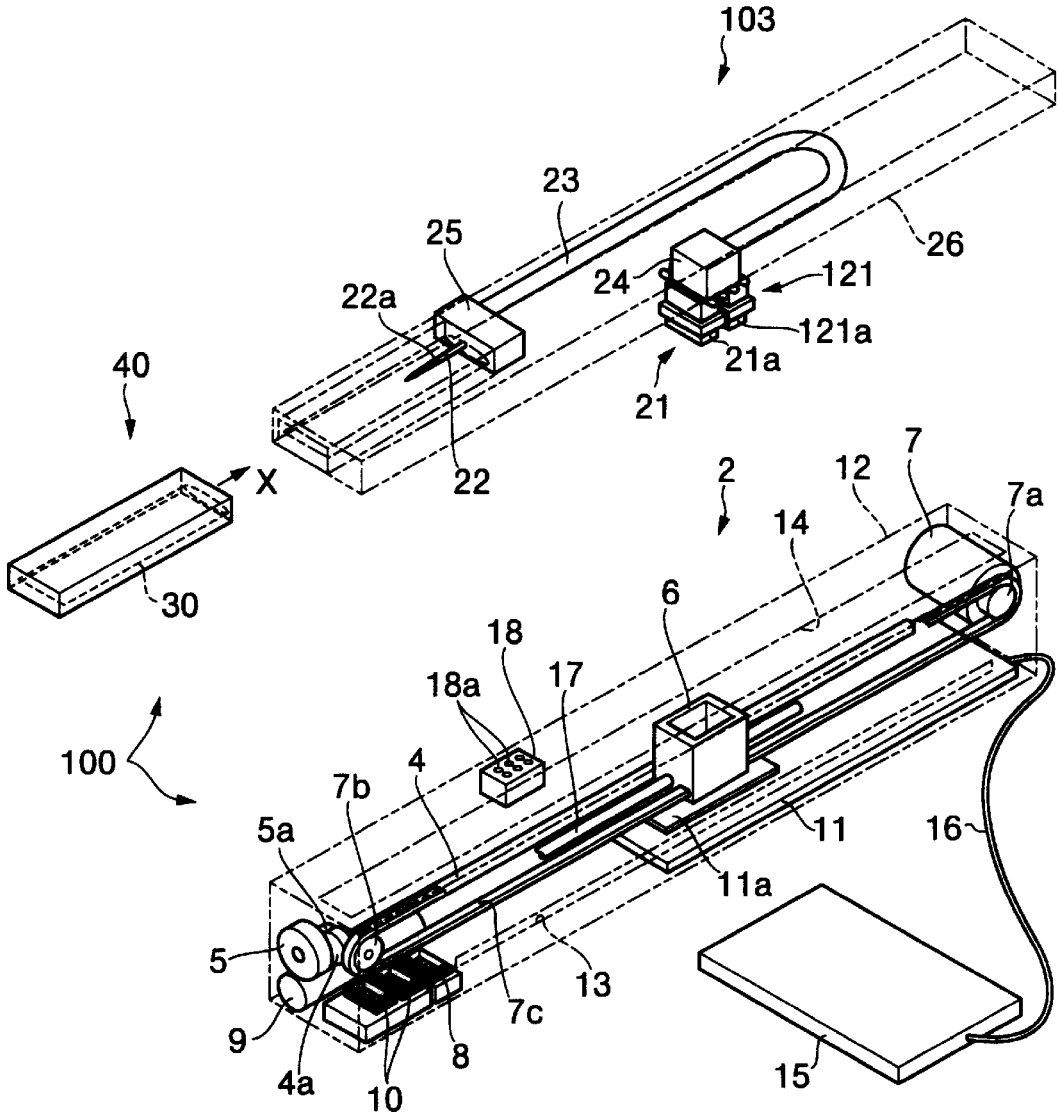
Figure 9:
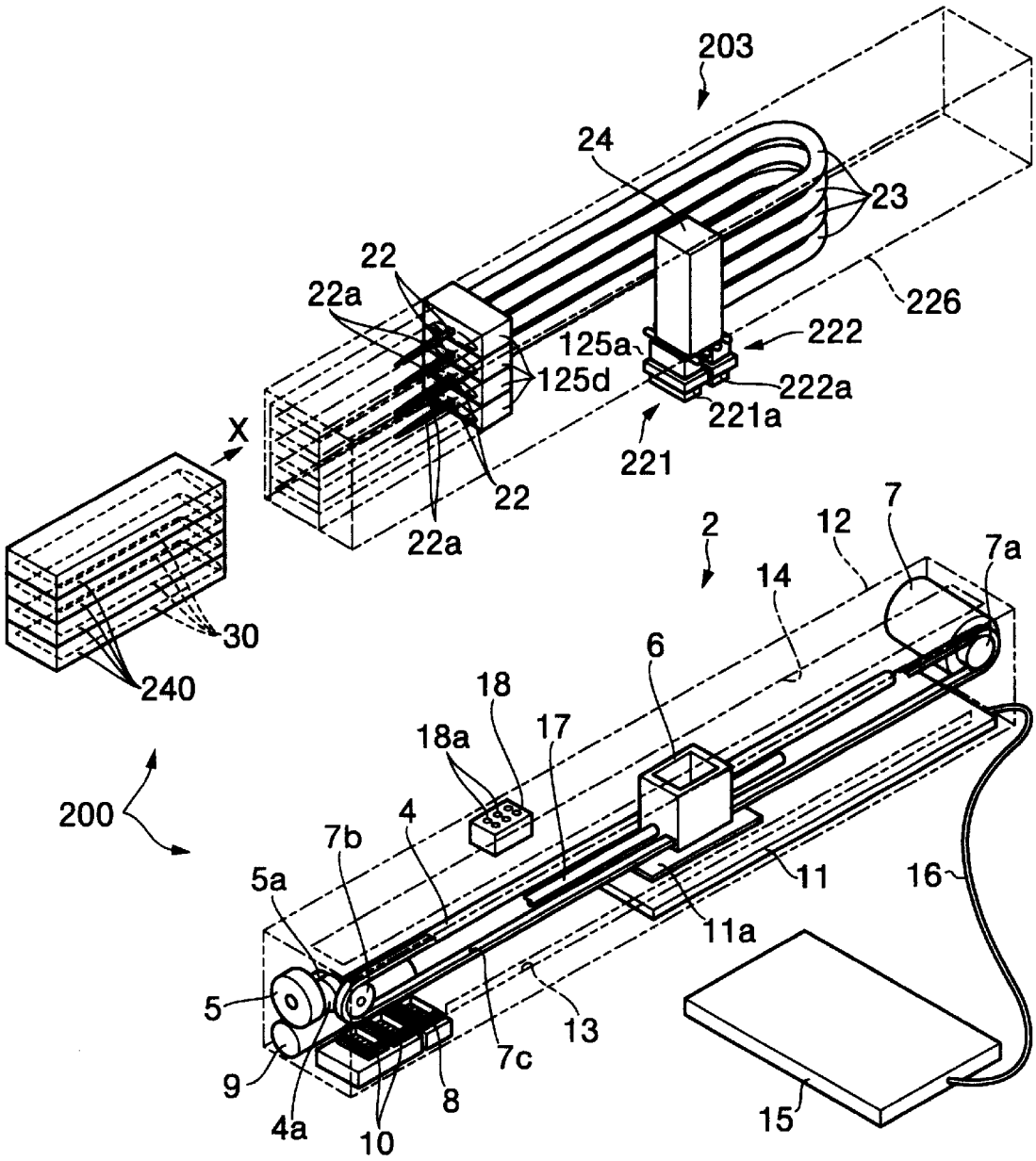
Figure 10:
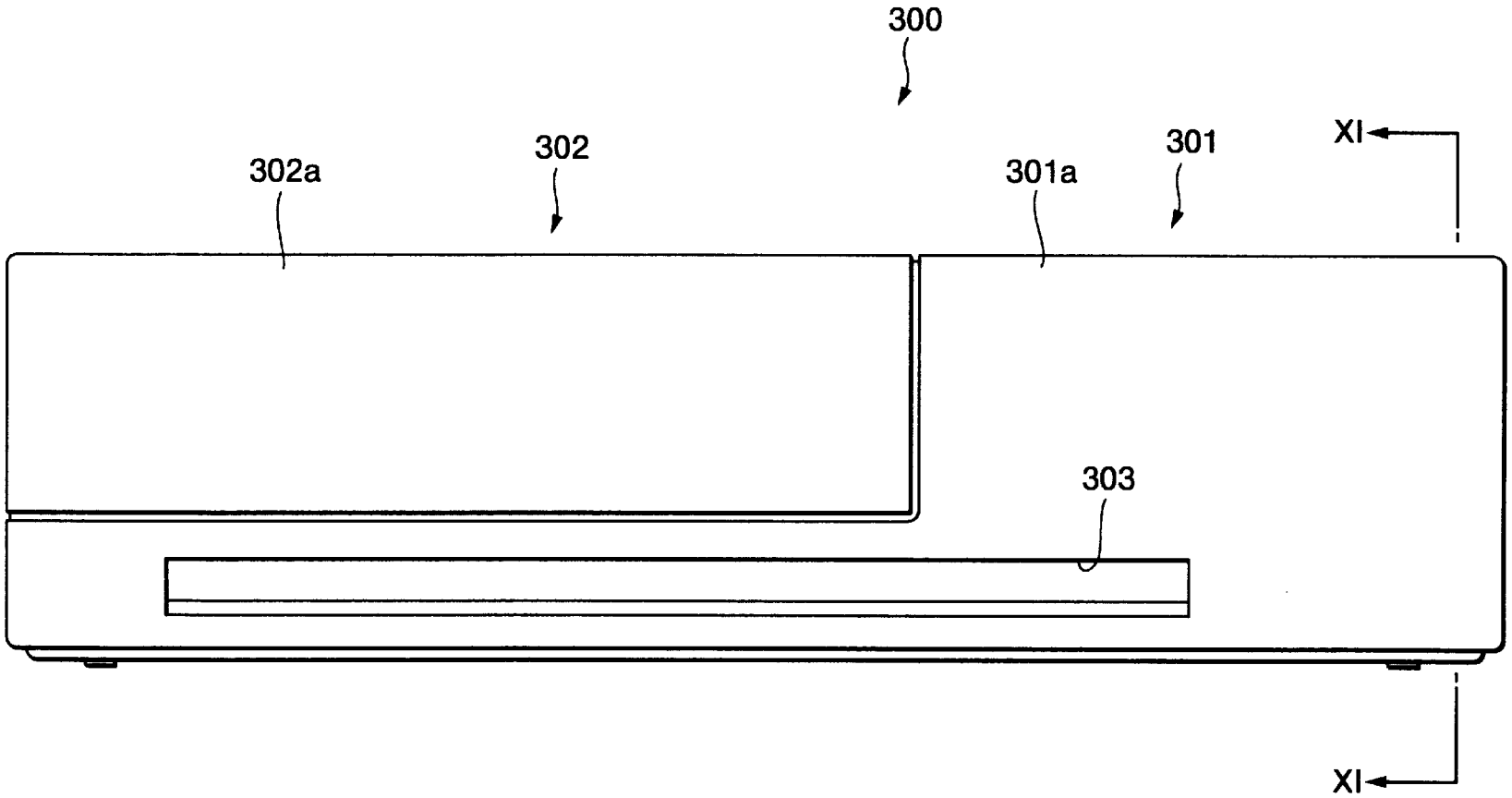
Figure 11:
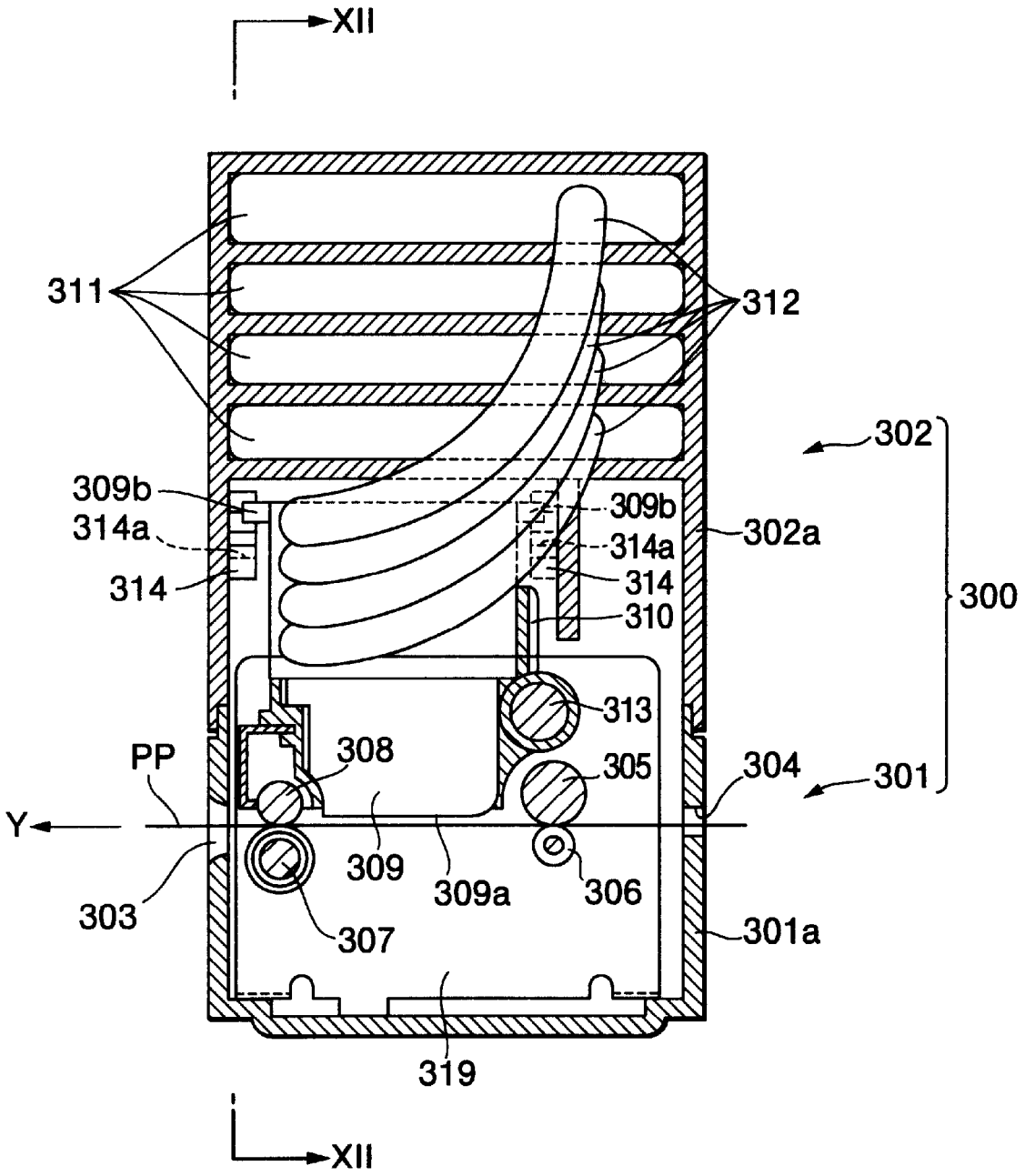
Figure 12:
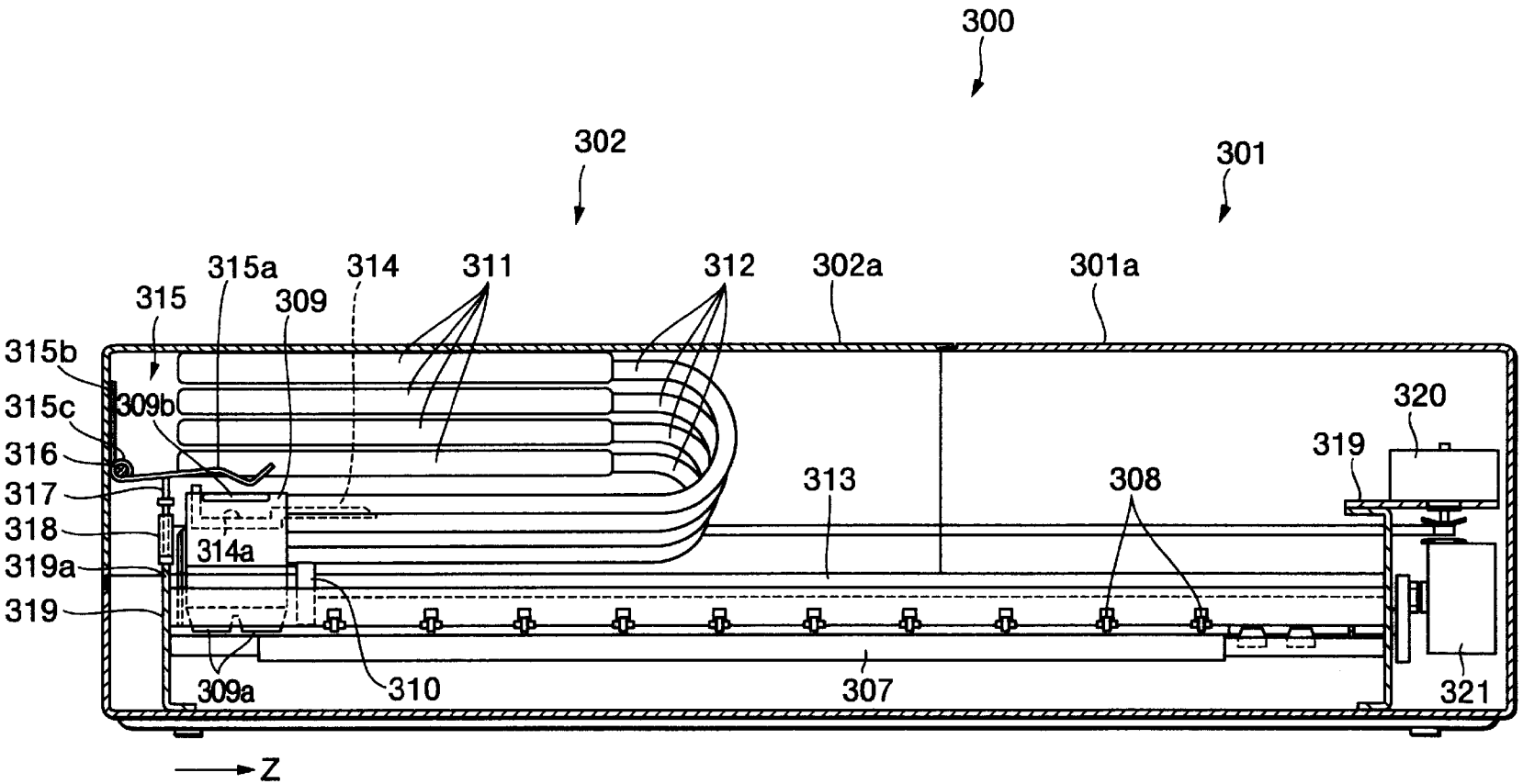
Figure 13:
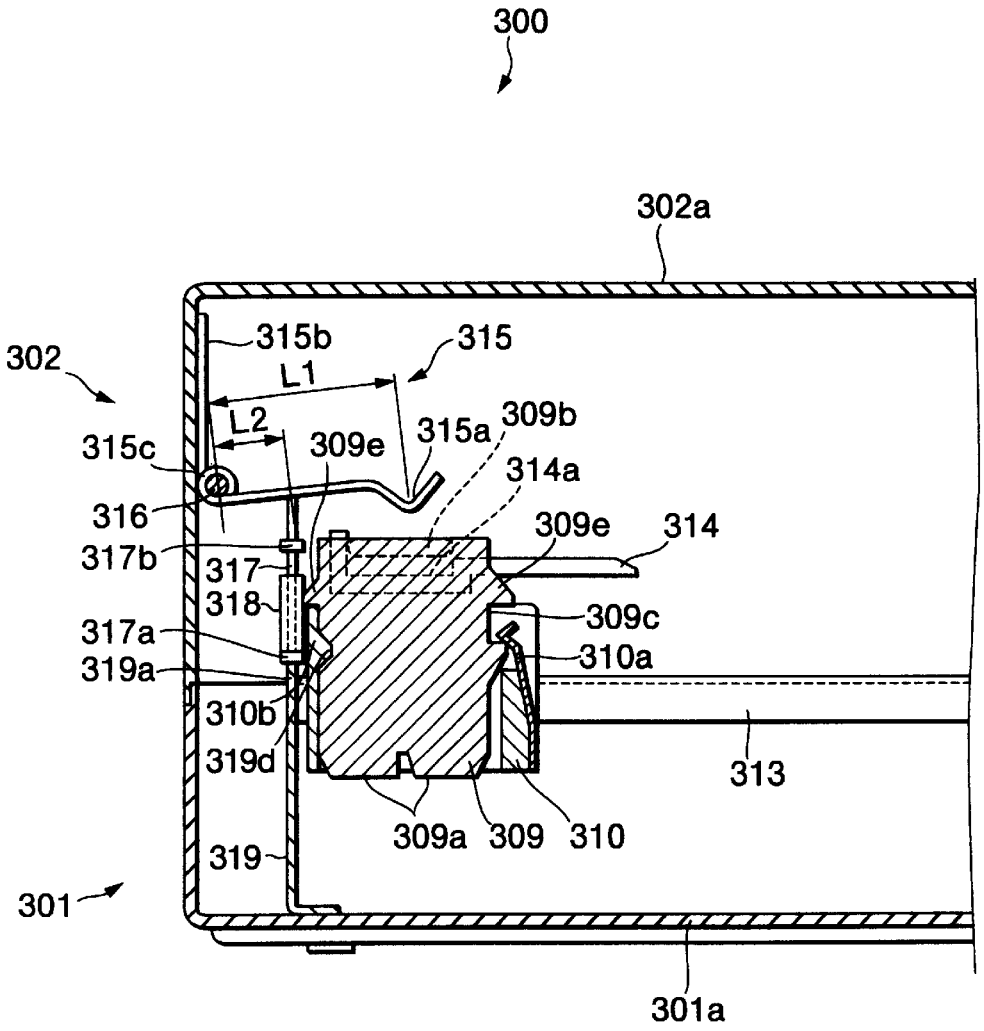
Figure 14:
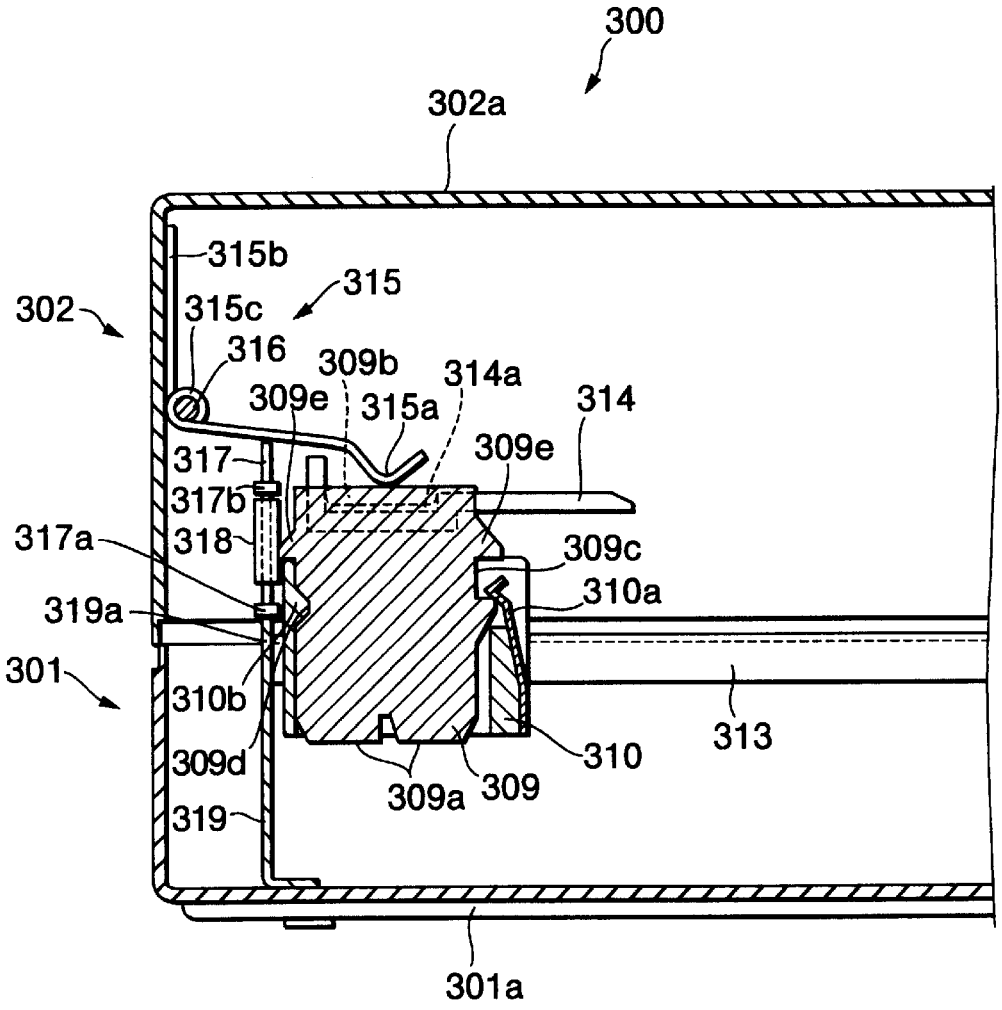
Figure 15:
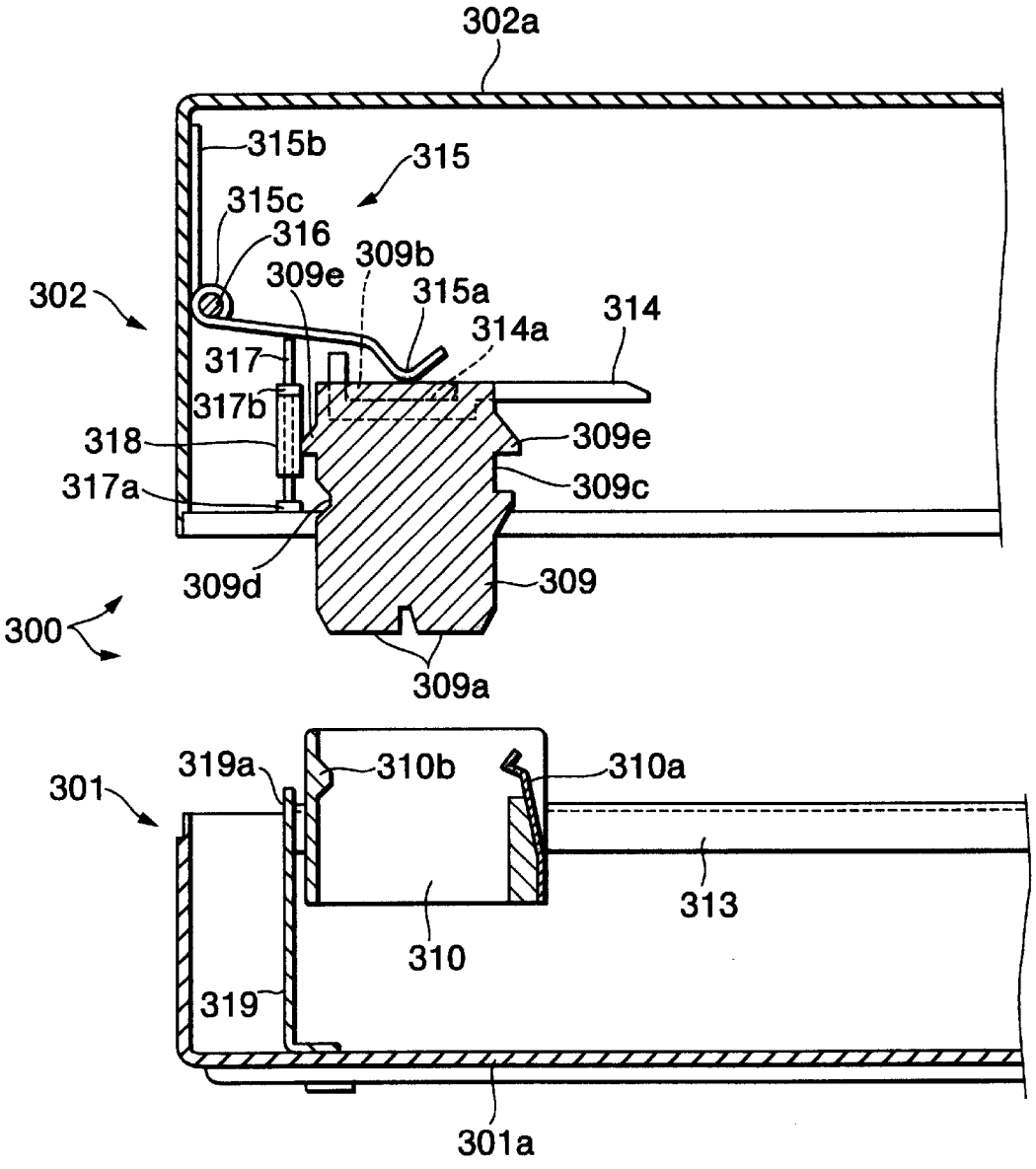

FIG.; 3 is an exploded perspective view showing an ink cartridge including an ink package used in the printer of FIG. 1;

FIG. 4 is a graph representing effect that thickness of laminated sheet forming the ink package has on the relationship between pressure in the ink packages and consumption of ink from the ink package;

FIG. 5 is a graph representing effect that length to wide ratio of ink package has on the relationship between pressure in the ink package and consumption of ink from the ink package;

FIG. 6 is a graph representing effect that length of the ink package has on the relationship between pressure in the ink packages and consumption of ink from the ink package;

FIG. 7 is a chart showing the effect that diameter of a needle used to pierce and extract ink from the ink package has on quality of seal formed between the ink package and the ink extraction needle;

FIG. 8 is an exploded perspective view showing an ink jet printer including a printer cartridge according to a second embodiment of the present invention;

FIG. 9 an exploded perspective view showing an ink jet printer including a printer cartridge according to a third embodiment of the present invention;

FIG. 10 is plan view showing an ink jet printer according to a fourth embodiment of the present invention;

FIG. 11 is a cross-sectional view taken along the line XI—XI of FIG. 10;

FIG. 12 is a front view as viewed from the line XII—XII of FIG. 11 for showing an internal arrangement of the ink jet printer;

FIG. 13 is an enlarged cross-sectional view showing details of a left side portion of FIG. 12;

FIG. 14 an enlarged cross-sectional view showing the view of FIG. 13 after a print cartridge has been lifted slightly upward; and FIG. 15 is an enlarged cross-sectional view showing the view of FIG. 14 after the print cartridge is separated from a printer body of the printer of FIG. 10.

DETAILED DESCRIPTION OF THE PREFERRED EMBODIMENTS

An ink jet printer 1 and a printer cartridge 3 assembled thereinto according to a first embodiment of the present invention will be described with reference to FIGS. 1 through 7. Throughout the specification, terms such as left, right, up, down, front, and rear for describing direction are used to describe locations of components in the ink jet printer 1 while the ink jet printer 1 is in the orientation in which it is intended to be used.

FIG. 1 shows a table top type ink jet printer 1 including a box-shaped printer body 2, the print cartridge 3, and an ink cartridge 40 housing an ink package 30 and that is detachably mountable on the print cartridge 3. The print cartridge 3 is detachably mountable on the printer body 2 and is provided with a print head 21.

The printer body 2 includes a main frame 12 having a front wall, a rear wall, a pair of side walls, a top wall and a bottom wall. A laterally extending discharge port 13 is formed in the front wall of the main frame 12 for discharging printed-on print sheets from the printer body 2, and a laterally extending head movement groove 14 is formed in the top wall. Although not shown in the drawings, a sheet supply port through which unprinted print sheets are inserted into the printer body 2 is formed at the rear wall and at a position opposing the sheet discharge port 13. The print cartridge 3 includes a cartridge frame 26. The main frame 12, the discharge port 13, the head movement groove 14, and the cartridge frame 26 are indicated by two-dot chain lines in FIG. 1. The movement direction for mounting the ink cartridge 40 onto the print cartridge 3 is indicated by an arrow X in FIG. 1.

A transport roller 4 for transporting a print sheet through the ink jet printer 1 is rotatably supported on the main frame 12 of the printer body 2. A follower gear 4*a* is attached to the left end of the transport roller 4. The follower gear 4*a* is meshingly engaged with a drive gear 5*a* of a line feed motor 5 disposed adjacent to the follower gear 4*a*. With this configuration, rotation of the line feed motor 5 rotates the drive gear 5*a* and consequently the transport roller 4 so that the print sheet can be is transported.

A guide bar 17 is disposed in the main frame 12 in parallel with the transport roller 4. It should be noted that the end portions of the guide bar 17 are not shown in FIG. 1. A carriage 6 on which the print head 21 of the print cartridge 3 is mounted, is itself mounted on the guide bar 17 via holes formed through the carriage 6. With this configuration, the carriage 6 can slidingly move along the guide bar 17 in a direction perpendicular to the transport direction of the print sheet.

A mechanism for driving the carriage 6 includes a carriage return (CR) motor 7 disposed at the right end of the main frame 12, a drive pulley 7*a* driven by rotation of the CR motor 7, a follower pulley 7*b* provided at the left end of the main frame 12, and a belt 7*c* spanning between the drive pulley 7*a* and the follower pulley 7*b* and connected to the carriage 6. With this configuration, rotation of the CR motor 7 rotates the drive pulley 7*a* so that the belt 7*c* reciprocally transports the carriage 6 in the lengthwise direction of the printer body 2, that is, in the direction parallel with the axes of the guide bar 17 and the transport roller 4. As a result, the print head 21 mounted on the carriage 6 is also reciprocally transported in the lengthwise direction of the printer body 2 so that printing can be performed on the print sheet. It should be noted that a portion of the belt 7*c* is omitted from FIG. 1 to facilitate understanding of the transport roller 4 and the guide bar 17.

Although the print head 21 and the ink cartridge 40 will be described in further detail later, it will be noted here that the print head 21 is mounted on the carriage 6, but the ink cartridge 40 is mounted at the left end of the cartridge frame 26 and not on the carriage 6. With this configuration, the load imparted on the carriage 6 when the carriage 6 is driven to move is less than if the ink cartridge 40 were also mounted on the carriage 6. For this reason, the ink jet printer 1 of the first embodiment requires less power to drive the carriage 6 than does a conventional printer wherein the ink cartridge is also mounted on the carriage. As a result, the load such as start-up torque on the CR motor 7 is reduced. Also, through-up period of the CR motor 7 can be reduced. These reductions in the load and through-up period of the CR motor 7 translate into a reduction in the amount of power consumed by the CR motor 7.

Because the load applied on the carriage 6 is reduced, a small motor with only a small amount of torque can be used as the CR motor 7. Because the CR motor 7 can be a small motor, the size of the printer body 2 of the ink jet printer 1 can be made more compact. Because the printer body 2 can be made more compact, the ink jet printer 1 is more portable and can be easily carried with and used with a laptop computer or a personal digital assistant (PDA).

Because only the print head 21 is mounted on the carriage 6, less drive force is required to drive the carriage 6. As a result, the CR motor 7 can drive the carriage 6 stably at a high speed. That is to say, because only the print head 21 is mounted on the carriage 6, the weight applied on the carriage 6 will not change as ink is consumed. This differs from the conventional situation wherein the ink cartridge is also mounted on the carriage. Accordingly, the ink jet printer 1 according to the first embodiment does not require a control means for controlling fluctuation in moving speed of the carriage 6 because moving speed of the carriage 6 will not change with consumption of ink. Therefore, overall cost of the ink jet printer 1 will be reduced by the cost of the unneeded control means.

Figure 2:
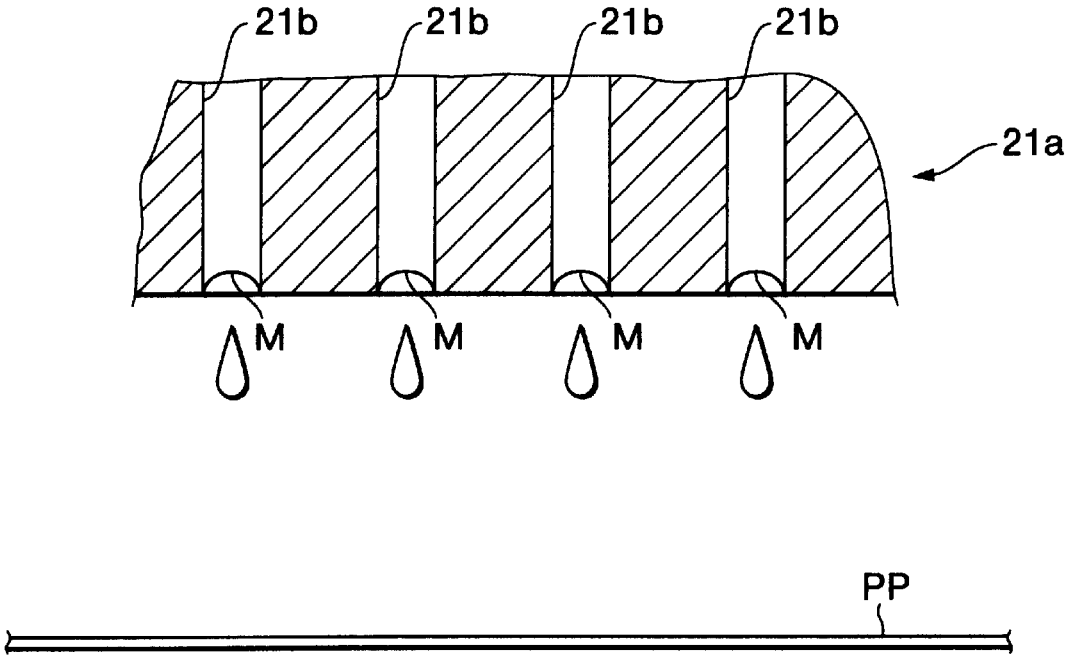
FIGS. 2 is a cross-sectional view showing a portion of a print head of the printer shown in FIG. 1.

The print head 21 has nozzles 21*a* including nozzle openings 21*b* (FIG. 2). A suction cap 8 and a suction pump 9 are disposed at the left end of the printer body 2. The suction cap 8 and the suction pump 9 are for performing purging processes for recovering the print head 21 to a proper ink ejecting condition. That is, the suction cap 8 is for sealing closed the nozzle openings 21*b*. The suction pump 9 is for sucking ink from the nozzle openings 21*b*, once the nozzle openings 21*b* are sealed closed by the suction cap 8. When these purge processes are to be performed, the CR motor 7 moves the carriage 6 mounted with the print head 21 to the left side of the ink jet printer 1, whereupon the suction cap 8 seals closed the nozzle openings 21*b* of the print head 21. When the suction pump 9 is driven while the suction cap 8 covers the nozzle openings 21*b* in this manner, dried ink and bubbles are sucked from the nozzle openings 21*b* so that the nozzle openings 21*b* of the nozzles 21*a* are recovered to a sufficient ink ejection condition. It should be noted that purge processes are performed when dried ink or the like clogs the nozzle openings 21*b*, which prevents the surface of the liquid ink filling the nozzle openings 21*b* from forming into a concave shaped meniscus M shown in FIG. 2.

A protective cap 10 for covering the nozzles 21*a* of the print head 21 is disposed at the left side of the suction cap 8. The protective cap 10 covers the nozzles 21*a* to prevent ink in the nozzles 21*a* from evaporating and drying out when printing is not performed using the print head 21, that is, when the carriage 6 is in a stand-by condition.

A control circuit board 11 mounted with a central processing unit (CPU) 11*a* and the like is disposed within the lower portion of the printer body 2. The CPU 11*a* is for controlling the ink jet printer 1 according to control programs with respect to an operation of the ink jet printer 1. A PC card 15 is connected to the control circuit board 11 via a connection cable 16. The PC card 15 is inserted into a PC card slot of a personal computer (not shown in the drawings) to enable input of print data and the like from the personal computer to the ink jet printer 1.

It should be noted that by inserting the PC card 15 into the PC card slot of the personal computer, power of the personal computer is also supplied to the ink jet printer 1 over the connection cable 16 and the PC card 15. Accordingly, there is no need to connect the ink jet printer 1 to an AC power source when the ink jet printer 1 is used to print. For example, the ink jet printer 1 can be used outside of the office or outdoors by using the power source of a laptop personal computer.

The printer 1 according to the present embodiment is designed so that the heavier components, such as the line feed motor 5 and the CR motor 7, are disposed in the printer body 2. As a result, the central gravity of the ink jet printer 1 is located in the printer body 2. Because the printer body 2 is disposed in the lower portion of the ink jet printer 1, the ink jet printer 1 is more stably set in place. With this configuration, the ink jet printer 1 can be prevented from falling over because of vibration caused by the movement of the carriage 6 or the transport roller 4, for example. Further, the printer body 2 can be prevented from toppling over when the print cartridge 3 is exchanged.

A connector 18 is disposed in the upper surface of the top wall of the main frame 12. The connector 18 is adapted for supplying power for driving the print head and electrical signals based on image data to the print head 21 of the print cartridge 3. Although not shown in the drawings, the connector 18 is connected to the control circuit board 11 disposed on the lower portion of the printer body 2. A plurality of connection holes 18*a* are formed in the upper surface of the connector 18. Each connector hole 18*a* is formed for receiving a particular one of a plurality of connection pins (not shown), which are provided on the lower surface of an attachment member 25 disposed on the print cartridge 3.

The rectangular shaped head movement groove 14 is provided in the upper wall of the main frame 12 so that when the print cartridge 3 is attached to the printer body 2, the print head 21 can be mounted in the carriage 6 through the head movement groove 14.

The print cartridge 3 is configured to be attachable to and detachable from the top wall of the printer body 2. The print cartridge 3 has a box shaped cartridge frame 26, which houses the print head 21 and other components, such as an ink extraction needle 22, an ink supply tube 23, an attachment member 24 and the attachment member 25. The attachment members 24, 25 are for connecting the ink extraction needle 22 and the print head 2 to the ink supply tube 23.

The print head 21 is installed so as to be capable of reciprocal movement in a main scanning direction, that is, in the lengthwise direction of the print cartridge 3. The print cartridge 3 supports the print head 21 along all or a portion of its reciprocal movement region within the print cartridge 3. This configuration is achieved by providing protrusion members that protrude from side or upper surfaces of the print head 21 and by also providing retaining members on the inner side walls of the print cartridge 3 for retaining these protrusion members. The retaining members are provided in the print cartridge 3 along a portion of the reciprocal movement region of the print head 21. Alternatively, the retaining members can be provided in the print cartridge 3 so as to span the entire reciprocal moving region of the print head 21.

By configuring the print cartridge 3 in this manner, the print head 21 is held by the retaining members at a position within the reciprocal moving region in the print cartridge 3. Therefore, when the print cartridge 3 is removed from the printer body 2, the retaining members lift up the protrusion members. Therefore, the print head 21 can be removed from the printer body 2 with the state that the print cartridge 3 holds the print head 21. Further, the print head 21 can be mounted onto the carriage 6 by fitting the print head 21 into the carriage 6 when the print cartridge 3 is mounted in the printer body 2.

In order t o accurately mount the print head 21 to and detach the print head 21 from the carriage 6 when attaching the print cartridge 3 to and detaching the print cartridge 3 from the printer body 2, the CPU 11*a*, for example, must control the stop of the carriage 6 always at a predetermined stop position upon completion of printing operations. This is particularly the case when the retaining members are provided in the print cartridge 3 along a portion of the reciprocal movement region of the print head 21. In this case, in order to accurately attach the print head 21 to and detach the print head 21 from the carriage 6 by attaching the print cartridge 3 to and detaching the print cartridge 3 from the printer body 2, the CPU 11*a* and the like must control to stop the carriage 6 at a position directly beneath the retaining members of the print cartridge 3 at the end of printing operations.

It should be noted that the protrusion members, the retaining members, and other means for mounting the print head 21 to the carriage 6, that is, when the print cartridge 3 is mounted onto the printer body 2, configure a print head mounting means and a print head detachment means of the present invention. An exemplary embodiment of this configuration will be described later while referring to FIGS. 10 through 15. Even though, FIGS. 10 through 15 pertain to a fourth embodiment, the print head mount-assist means and print head detachment means shown in FIGS. 10 though 15 are also provided in the first through third embodiments.

The print head includes the nozzles 21*a* formed from piezoelectric elements. As shown in FIG. 2, the nozzles 21*a* include the plurality of nozzle openings 21*b*. Each nozzle opening 21*b* is filled with ink supplied from the ink package 30 housed in the ink cartridge 40. When a voltage is applied to the nozzles 21*a*, the nozzles 21*a* deform to an extent proportional to the applied voltage so that the volume of each nozzle opening 21*b* can be selectively reduced. When the volume of one of the nozzle openings 21*b* is reduced, the ink filling the particular nozzle opening 21*b* is ejected toward the print sheet PP so that printing is performed. It should be noted that the printing method used to drive the print head 21, which is provided with the nozzles 21*a* made from piezoelectric elements, will be referred to as a piezoelectric drive method hereinafter in the present specification.

Piezoelectric elements require less power to eject ink droplets than do the ink ejection means of a thermal jet (bubble jet) method. Therefore the piezoelectric drive method consumes less power than does the thermal jet method. The ink jet printer 1 saves power because it uses the piezoelectric drive method and also because the CR motor 7 is burdened with a smaller load as described previously. These power savings enable reduction of power consumption by the ink jet printer 1. Also, the PC card 15 can be used to supply power to the ink jet printer 1 from the power source, such as a small dry cell battery or a secondary cell battery, of a laptop type personal computer.

The nozzle openings 21*b* of the print head 21 are spaced away from each other by a pitch of approximately 180 dots per inch (dpi). The carriage 6 mounted with the print head 21 can print monochrome characters and the like at the resolution of 180 dpi by reciprocally moving in the lengthwise direction of the printer body 2 as viewed in FIG. 1.

When the ink filling the nozzle openings 21*b* has a concave shaped meniscus M at the lower surface of the ink, proper ink ejection can be achieved so that clear printing results can be obtained. Concave menisci M can be formed in the nozzle openings 21*b* by maintaining negative pressure in the ink filling the nozzle openings 21*b*. For example, concave menisci M can be formed at the ink surface in the nozzle openings 21*b* by maintaining the ink supply pressure in the print head 21 to within an operating pressure range of from about not less than 0 mm Aq (water column) to about not more than about −300 mmAq (water column) with respect to atmospheric pressure. It should be noted that the method of maintaining a negative pressure in the ink supply pressure will be later explained while explaining the ink package 30.

As shown in FIG. 1, one end of the ink supply tube 23 is connected to the print head 21 by the attachment member 24, which is provided on the upper portion of the print head 21, and the other end of the ink supply tube 23 is attached to the ink extraction needle 22 through the attachment member 25. The ink extraction needle 22 is for extracting ink from the ink package 30 housed within the ink cartridge 40. The ink extracted by the ink extraction needle 22 is supplied to the print head 21 via the ink supply tube 23 and the attachment members 24, 25.

The ink supply tube 23 is generally linear in shape but curves greatly near the attachment member 24. For this reason, the ink supply tube 23 is formed shorter than conventional tubes, and without a plurality of bends in the tube in the manner of conventional ink supply tubes. Because the ink supply tube 23 is shorter than conventional ink supply tubes and without any discontinuous bent portions, resistance to flow of ink flowing through the ink supply tube 23 to the print head 21 can be reduced. Also, the amount of ink sucked out during purge operations, which also sucks ink out of the ink tube in addition to out of the print head, is also reduced. Further, because the short ink supply tube 23 can be used, manufacturing costs can be reduced.

Although not shown in the drawings, a harness and the like is formed integrally with the ink supply tube 23 and is connected between the print head 21 and the attachment member 25. The harness is for supplying power for driving the print head 21 and is for supplying electric signals based on image data to the print head 21.

Although not shown in the drawings, a plurality of connection pins are provided to the lower surface of the attachment member 25. Each connection pin is formed so as to be insertable into the corresponding one of the plurality of connection holes 18*a* formed in the upper surface of the connector 18. Each connection pin of the attachment member 25 is inserted into the corresponding connection hole 18*a* of the connector 18 when the print cartridge 3 is mounted onto the printer body 2. As a result, the print head 21 and the control circuit board 11 are connected via the attachment member 24, the ink supply tube 23, the attachment member 25, and the connector 18. Therefore, power for driving the print head and electric signals based on image data can be supplied from the control circuit board 11 to the print head 21.

The print head 21, the ink extraction needle 22, the ink supply tube 23, and the attachment members 24, 25 will be referred to collectively as the print head 21 and the like, hereinafter. The print head 21 and the like are connected and adhered using adhesive or fuse-bonding. That is, no seal members such as detachable O-rings are used in the print cartridge 3. Therefore, when breakdowns or other problems occur at positions anywhere in the print cartridge 3, the problem can be resolved by disposing of the print cartridge 3 and replacing it with a new print cartridge 3 of the same type. For this reason, there is no need to exchange separately each part of the print cartridge 3 so that maintenance of the ink jet printer 1 is easily performed. Because there is no need to solely exchange the print head 21 separately, there is no danger that the user will accidentally touch the nozzles 21*a* of the print head 21 and stain his or her hand.

Because sections of the print head 21 and the like are attached or connected by fuse-bonding or by adhering with adhesive, the connection portions and the attachment portions of the print head 21 and the like can be maintained in an air tight condition. Accordingly, air and the like will not enter into the print head 21, and, ink will not leak out of the print head 21 through the adhering or bonding part.

The ink extraction needle 22 is formed in a hollow needle shape and is formed with an ink extraction port 22a in its tip. With this configuration, the ink extraction needle 22 can be inserted into an ink holding portion 31 of the ink package 30 to extract ink from the ink holding portion 31 through the ink extraction port 22*a*. The ink extraction needle 22 is formed from a corrosion resistant ceramic or metal, such as stainless steel.

This ink extraction operation will described in more detail here. First, the ink cartridge 40 housing the ink package 30 is inserted into the print cartridge 3 and slid in the direction indicated by an arrow X in FIG. 1. This sliding motion inserts the ink extraction needle 22 into the ink holding portion 31 through a through hole 42 shown in FIG. 3. Once the ink cartridge 40 is disposed adjacent to the attachment member 25 as indicated in two-dot chain line in FIG. 1, ink within the ink package 30 flows into the hollow space of the ink extraction needle 22 through the ink extraction port 22*a*. Ink that flows into the ink extraction needle 22 further flows into the ink supply tube 23 through the attachment member 25. Further, ink is supplied to the ink head 21 through the attachment member 24. An explanation of the ink package 30 will be provided later along with description of an outer diameter d of the ink extraction needle 22.

The print cartridge 3 is designed to be light weight. That is, the print cartridge 3 is installed with components, such as the print head 21 and the ink supply tube 23, that are lighter than components, such as the CR motor 7, the line feed motor 5, and the guide bar 17, which are installed in the printer body 2. For this reason, the print cartridge 3 is easily lifted up and carried around when exchanging the print cartridge 3. Also, the print cartridge 3 will not cause injury to hands or feet, for example, if accidentally dropped.

Figure 3:
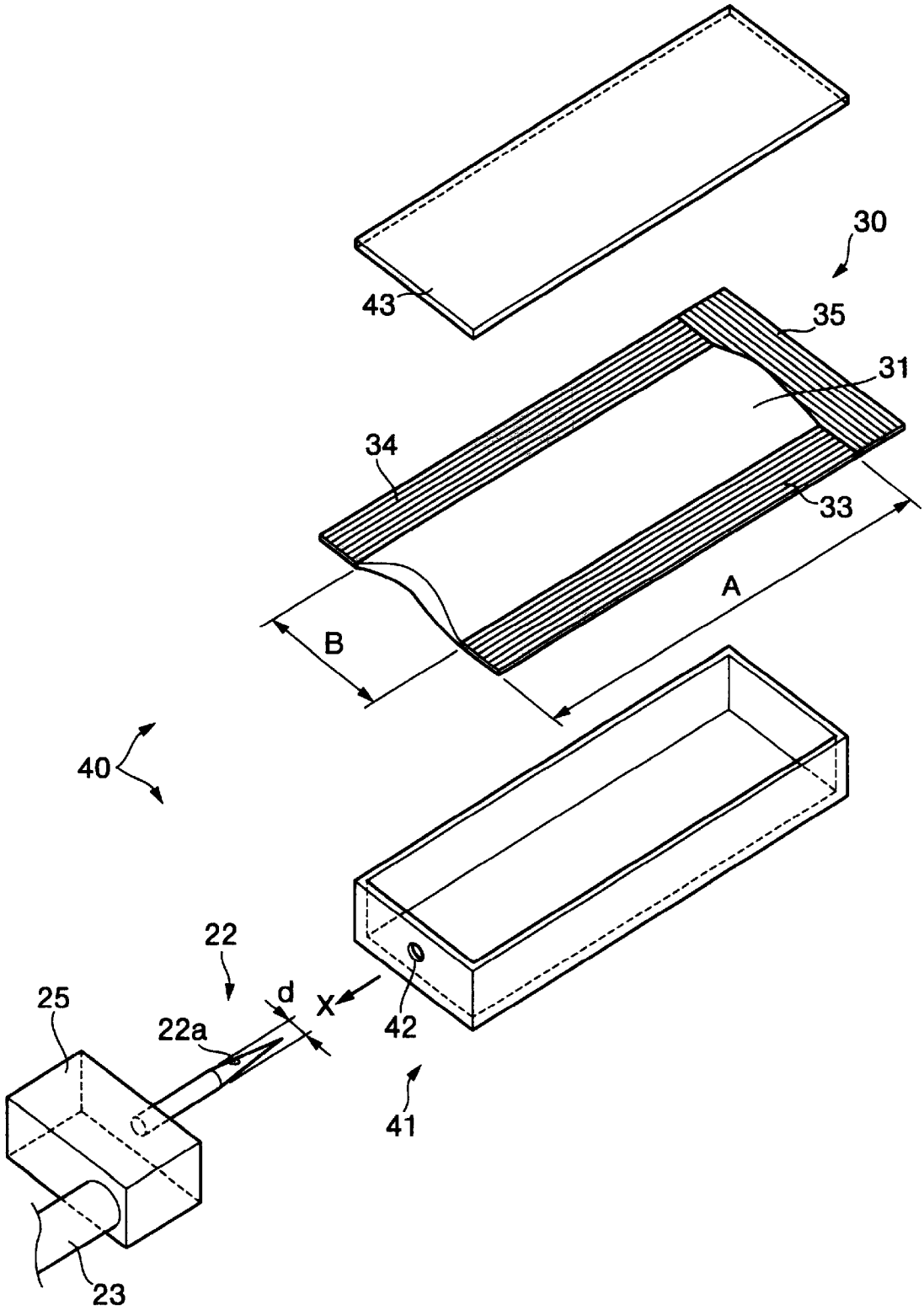

Next, the ink package 30 and the ink cartridge 40 housed therein will be described in detail while referring to FIGS. 3 to 6. As shown in FIG. 3, the ink cartridge 40 is formed in a substantially box shape and is detachable from the print cartridge 3. The ink cartridge 40 includes a cartridge body 41, a lid 43, and the ink package 30. The cartridge body 41 is opened at its upper surface to enable insertion of the ink package 30. The lid 43 is provided for covering the upper open end of the cartridge body 41 after the ink package 30 has been inserted therein. After the lid 43 is placed over the upper open end of the cartridge body 41, the lid 43 is fuse-bonded to the cartridge body 41 to attach it to cartridge body 41. Instead of fuse-bonding the lid 43 to the cartridge body 41, the lid 43 can be attached to the cartridge body 41 by providing attachment members to both the cartridge body 41 and the lid 43.

The through hole 42 is opened to the side wall of the cartridge body 41. As described above, the ink extraction needle 22 is inserted into the ink cartridge 40 through the through hole 42. By inserting the ink extraction needle 22 into the through hole 42, the ink extraction needle 22 can be inserted into an indentation portion 32 of the ink package 30 housed in the ink cartridge 40. Providing a seal member, such as packing formed, for example, from NBR to the through hole 42 is helpful in preventing ink from leaking out of the ink cartridge 40 when the ink cartridge 40 is removed from the print cartridge 3 and the ink extraction needle 22 is removed from the ink package 30. It should be noted that to fit the ink package 30 within the ink cartridge 40, heat seal portions 33, 34, 35 of the ink package 30 can be either folded and bent while the ink package 30 is being inserted into the ink cartridge or cut off before the ink package 30 is inserted into the cartridge body 41.

The ink package 30 is formed into a substantially rectangular bag shape from a laminated film formed from a plurality of, for example, ten polyethylene resin film sheets. The ink holding portion 31, which is filled with ink for printing, is formed in the approximate center of the ink package 30. The left edge of the ink holding portion 31 is defined by the indentation portion 32, which has an indented shape as viewed from above and which is where the ink extraction needle 22 is inserted. The other three edges are defined by the heat seal portions 33, 34, 35. With this configuration, the indentation portion 32 is supported at both ends by heat-seal portions 33, 34. Therefore the ink extraction needle 22 can easily penetrate into the ink holding portion 31 when the ink extraction needle 22 is inserted into the indentation portion 32.

Here, a method for manufacturing the ink package 30 will be described. First, the rectangular shaped laminated film is folded in half so that the two halves overlap each other. The overlapping edges opposite the folded portion of the laminated film member are heat-sealed together to form the heat seal portion 35. At this point, the laminated film is in a hollow tubular shape. Next, the overlapping edges at one of the open ends of the hollow tube are heat-sealed together to form the heat-seal portion 33. At this point, the laminated film is in the shape of a bag, with the end corresponding to the fused portion 34 still open. Next, ink is introduced into the bag through this open portion. After ink is introduced into the bag, the open end of the bag, which is positioned opposite of the fused portion 33, is fused closed to form the fused portion 34 and the indentation portion 32 at one edge of the ink holding portion 31.

At this point, the ink package 30, wherein ink is sealed in the ink holding portion 31, is positioned at one end of the folded halves of the rectangular shaped lamination film. After the ink package 30 is formed, the heat seal portion 34 is cut from the folded halves, so that the ink package 30 can be separated from the folded halves. This completes production of the ink package 30. It should be noted that the ink holding portion 31 is maintained at a positive pressure while ink is being introduced into the bag. This prevents air and the like from being introduced into the ink holding portion 31 of new and unused ink packages 30.

Next, a manner for maintaining ink supply pressure of ink supplied to the print head 21 will be described. The ink package 30 is formed from the laminated film member as described above. Therefore, when the ink package 30 is penetrated with the ink extraction needle 22, the outer peripheral surface of the inserted ink extraction needle 22 is in a sealed condition with the laminated film member of the ink package 30. Accordingly, ink can be prevented from leaking out of the ink holding portion 31. Also, air can be prevented from entering into the ink holding portion 31, in particular while ink is being extracted through the ink extraction needle 22 during consumption of ink. Said differently, ink extracted from the ink holding portion 31 is not replaced by air and the like in amounts that correspond to the amount of ink consumed. Therefore, the internal pressure P of the ink holding portion 31 is maintained in a negative pressure.

Further, strengthening the rigidity of the laminated film member forming the ink package 30 increases a dimensional stability or shape-restoring property of the laminated film member, thereby preventing the ink holding portion 31 of the ink package 30 from changing its shape. Therefore, ink can be extracted from the ink holding portion 31 through the ink extraction needle 22 without the ink holding portion 31 being compressed by atmospheric pressure and the like. As a result, the internal pressure P of the ink holding portion 31 can be maintained at a negative pressure so that when the ink extracted from the ink extraction needle 22 is supplied to the print head 21, the ink supply pressure of ink can be maintained at a negative pressure.

Next, an explanation for a method of strengthening the rigidity of the laminated film member will be provided while referring to FIGS. 4 through 6. FIG. 4 is a graph comparing ink packages 30 in which thickness w of the laminated structure film materials is different, FIG. 5 is a graph comparing ink packages 30 in which the ratio h of the longitudinal direction length A to the lateral direction length B (aspect ratio) of the ink sealing portion 31 is different, and FIG. 6 comparing ink packages 30 in which either one of the longitudinal direction length A or the lateral direction length B of the ink sealing portion 31 is different. In FIGS. 4–6, the horizontal axes 51, 61 and 71 represent the consumed amount V of the ink sealed inside the ink sealing portion, and the vertical axes 52, 62 and 72 represent the inner pressure P inside the ink holding portion 31.

Regarding the thickness w of the laminated structure film materials in the respective ink packages 30 shown in FIG. 4, the curves 53 (alternating long and short dashed line), 54 (alternating long and two short dashed line), 55 (solid line), 56 (dotted line) and 57 (broken line) correspond to 300 ìm, 160 ìm, 100 ìm, 80 ìm and 30 ìm, respectively. When the respective curves 53–57 are compared, with increase in the amount V of consumed ink, the inner pressure P drastically decreased in the order of curves 53, 54, 55, 56 and 57. In other words, as the thickness w of the laminated structure film material increases, the rigidity of the film material forming the ink sealing portion 31 increases. With these thickness, the shape stability of the laminated structure film material becomes significantly large, and a change in the shape of the ink sealing portion 31 is restrained. Thus, in the present embodiment, on the basis of the result from FIG. 4, the thickness w of the laminated structure film material is set from approximately 30 ìm to approximately 300 ìm, in order to set the ink supplying pressure, that is, the inner pressure P inside the ink sealing portion 31, 25 within the print head workable pressure ranging from approximately −100 mmAq to approximately 0 mmAq.

Since in the present embodiment the thickness w of the laminated structure film material is set approximately 30 ìm to approximately 300 ìm, in the aforementioned manner, an excessive increase in heating time and an excessive rise in heating temperature are prevented in the fuse-bonding step for forming the heat-sealed portions 33, 34 and 35 of the ink package 30. Thus, the cost for making the ink package 30 can be reduced. Further, the ink extraction needle 22 can be easily inserted into the ink package 30 with little resistance.

Regarding the aspect ratio h of the ink holding portion 31 of the respective ink packages 30 shown in FIG. 5, the curves 63 (alternating long and two short dashed line), 64 (solid line) and 65 (dotted line) correspond to "1", "1.5" and "2", respectively. When the respective curves 63–65 in FIG. 5 are compared, with an increase in the amount V of consumed ink, the inner pressure P drastically decreased in the order of curves 63, 64 and 65. In other words, as the aspect ratio h of the ink sealing portion 31 decreases, the rigidity of the laminated structure film material 10 forming the ink holding portion 31 increases Therefore, with these ratio, the shape stability of the laminated structure film material becomes significantly large, and a change in the shape of the ink holding portion 31 is prevented. Thus, in the present embodiment, on the basis of the result from FIG. 5, the aspect ratio h of the ink holding portion 31 is set about from "1" to "2", that is, the length in the longitudinal direction A (the length in the lateral direction) of the ink holding portion 31 is set to about from 1 to 2 times as long as the lateral direction length B (the length in the longitudinal direction A), in order to set the ink supplying pressure, that is, the inner pressure P in the ink sealing portion 31 within the print head workable pressure ranging from approximately −100 mmAq to approximately 0 mmAq. It should be noted that in FIG. 5, "A:B=2:1" provided the result the same as the result of "A:B=1:2". In other words, in the lower limit, the one side and another side perpendicular to the one side has the same length, and in the upper limit, the one side has a length twice as long as the other side.

Regarding the length in the longitudinal direction A (the length in the lateral direction B) of the holding portion 31 of the respective ink packages 30 shown in FIG. 6, the curves 73 (alternating long and short dashed line), 74 (alternating long and two short dashed line), 75 (solid line), and 76 (dotted line) correspond to 30 mm, 50 mm 70 mm and 100 mm, respectively. When the respective curves 73–76 in FIG.6 are compared, with an increase in the amount V of consumed ink, the inner pressure P drastically decreased in the order of curves 73, 74, 75 and 76. In other words, as the length in the longitudinal direction A (the length in the lateral direction B) of the ink holding portion 31 decreases, the rigidity of the ink holding portion 31 increased. Therefore, the shape stability of the laminated structure 30 film material becomes significantly large, and a change in the shape of the ink sealing portion 31 is prevented. Thus, in the present embodiment, on the basis of the result from FIG. 6, the longitudinal direction length A (the lateral direction length) of the ink holding portion 31 is set about 100 or less mm, in order to set the ink supplying 17 pressure, that is, the inner pressure P in the ink sealing portion 31 within the print head workable pressure ranging from approximately −100 mmAq to approximately 0 mmAq. It should be noted that this length is available for both the side A and side B.

Next, while referring to FIG. 7, an explanation will be provided for the relationship between diameter d of the ink extraction needle 22 and the seal formed between the ink package 30 and the ink extraction needle 22. In the chart of FIG. 7, the seal formed between the ink package 30 and the ink extraction needle 22 is represented as a pressing force F. The pressing force F was determined for each different diameter ink extraction needle 22 by inserting each ink extraction needle 22 into an ink package 30, and measuring the pressing force F applied to the ink package 30 in its thickness directions at the time when the ink extraction needle 22 was pushed out of ink package 30. The ink package 30 used during these experiments was formed from a laminated film member having a thickness of about 100 $\mu$m.

As shown in FIG. 7, as the outer diameter d of the ink extracting member 22 increased, the pressing power F that the ink extraction member 22 is pulled out from the ink package 30 increased. Preferably, the pressing power F is approximately 100 g or less. On the basis of this result, the outer diameter d of the ink extracting member 22 is set to about 5 mm or less, in order to maintain the intimate contact power of the outer surface of the ink extraction member 22 stuck into the ink package 30 with the laminated structure film material of the ink package 30.

The ink supply pressure can be adjusted and maintained at a negative pressure by supplying ink to the print head 21 using this ink package 30 and the ink extraction needle 22 formed as described above. Therefore, there is no need to provide an ink supply pressure adjustment means, such as an ink supply pump and a sub-tank disposed below the print head 21 for generating a negative ink supply pressure. As a result, the ink jet printer 1 can be produced with fewer components so that overall costs of making the ink jet printer 1 can be reduced. Because no ink supply pump and the like is needed, the ink jet printer 1 can be driven without consuming as much power as conventional printers. The details of the lamination film and the ink package 30 is described, for example, in a copending U.S. patent application Ser. No. 09/132,486 filed Aug. 11, 1998, the disclosure of which is hereby incorporated by reference.

Next, while referring to FIGS. 1 to 3, a method for assembling the ink jet printer 1 will be described. First, the ink package 30 shown in FIG. 3 is inserted into the cartridge body 41 by either bending or partly cutting the heat-seal portions 33, 34, 35 of the ink package 30. After the ink package 30 is inserted into the cartridge body 41, the lid 43 is placed on the top of the cartridge body 41. Then the ink package 30 is sealed within the ink cartridge 40 by fuse-bonding the lid 43 to the cartridge body 41.

Next, the through hole 42 of the ink cartridge 40 is aligned with the ink extraction needle 22. By sliding the ink cartridge 40 in the direction X, the ink extraction needle 22 is inserted into the through hole 42 of the ink cartridge 40. After the ink extraction needle 22 is inserted into the through hole 42, the ink extraction needle 22 easily pierces the indentation portion 32 of the ink holding portion 31 of the ink package 30 housed in the ink cartridge 40. Because the indentation portion 32 of the ink package 30 is supported at its two sides by the heat-seal portions 33, 34, the ink holding portion 31 can be prevented from deforming when pressed by the ink extraction needle 22 and when the ink extraction needle 22 pierces the indentation portion 32.

When the ink cartridge 40 is further slid in the direction X, the ink cartridge 40 will be installed in the left-hand portion of the print cartridge 3 in the position indicated by the two dot chain line at the left-hand side of the FIG. 1. This completes operations for mounting the ink cartridge 40 into the print cartridge 3. In the mounted condition, the ink cartridge 40 will tilt downward toward the attachment member 25, that is, toward the right center as viewed in FIG. 1. Said differently, the ink cartridge 40 will be disposed so that it tilts downward from the left end of the ink cartridge 40 to the right end of the ink cartridge 40. With this orientation, any air and the like mixed in the ink when filling the ink package 30 during manufacture of the ink package 30 will gather at the upper left end of the ink cartridge 40. Therefore, air can be prevented from entering the ink extraction needle 22. It is desirable that when the ink cartridge 40 is in its mounted condition in the ink package 30, it should have a slanting angle of about 0 to 10 degrees or optimally about 0 to 3 degrees. Further, because the laminated film member forming the ink package 30 is in sufficient sealing contact with the outer peripheral surface of the ink extraction needle 22, air can be prevented from entering the ink package 30 and ink can be prevented from leaking out of the ink package 30.

When the ink extraction needle 22 pierces the ink holding portion 31 of the ink package 30, ink is extracted from the ink holding portion 31 through the ink extraction port 22*a*. The ink flows through the attachment member 25, the ink supply tube 23, and the attachment member 24, whereupon it is supplied to the print head 21. Because the laminated film forming the ink package 30 has strength and rigidity sufficient to enable the ink package 30 to recover its shape, change in the shape of the ink holding portion 31 of the ink package ink package 30 is restricted. Accordingly, the internal pressure P of the ink holding portion 31 can be maintained in a negative pressure while ink is being extracted through the ink extraction needle 22. That is, the ink holding portion 31 will not be squeezed by atmospheric pressure and the like so that the ink supply pressure can be maintained at negative pressure when ink extracted by the ink extraction needle 22 is supplied to the print head 21. As a result, a concave meniscus M can be formed in ink filling each of the nozzle ports 21*b*, thereby enabling the print head 21 to properly eject ink to produce good clean printing results.

Next, the print cartridge 3 is mounted onto the printer body 2 while inserting the print head 21 of the print cartridge 3 into the carriage 6 of the printer body 2. At this time, the print head 21 can be easily mounted of the carriage 6 without any labor by merely mounting the print cartridge 3 onto the printer body 2 using a print head mounting means to be described later. After the print cartridge 3 has been mounted, the PC card 15 of the ink jet printer 1 is inserted into the PC slot of a personal computer to electrically connect the ink jet printer 1 with the personal computer. In this condition, power is supplied from the personal computer to the ink jet printer. Also print data and the like can be transmitted between the personal computer and the ink jet printer 1.

Printing is performed on the print sheet PP when the ink jet printer 1 receives transmission of print data from the personal computer. In this case, when an unused print sheet PP is inserted into the sheet supply port (not shown) of the ink jet printer 1, the transport roller 4 transports the print sheet PP along the transport pathway under the print head 21, which is mounted on the carriage 6. When the transported print sheet PP passes through the transport pathway under the print head 21, the print head 21 ejects ink from the nozzle ports 21*b* to print characters and the like on the print sheet PP. This printed print sheet PP is then discharged through the discharge port 13.

Next, while referring to FIG. 8, an ink jet printer 100 having a print cartridge 103 according to a second embodiment of the present invention will be explained. The print cartridge 103 of the ink jet printer 100 is a modification of the print cartridge 3 of the first embodiment.

The print cartridge 103 of the ink jet printer 100 includes a print head 121, which is similar to the print head 21. The print heads 21 and 121 are positioned side by side in the scanning direction of the carriage. The print head 121 includes a row of nozzles 121*a* at its lower surface. In a manner similar to the print head 21, A nozzle opening is formed at the lower end of each nozzle of the row of nozzles 121*a*. The nozzle opening are disposed at a pitch corresponding to 180 dpi. The rows of nozzles 21*a*, 121*a* are shifted with respect to each other in the sheet feeding direction by a half pitch distance, that is, by a distance corresponding to a pitch of 360 dpi. When both the print heads 21, 121 are used for printing, printing can be performed at a resolution of 360 dpi by reciprocally moving the carriage 6, on which both of the print heads 21, 121 are mounted, in the lengthwise direction of the printer body 2. Accordingly, the ink jet printer 100 according to the second embodiment can perform higher resolution printing within a shortened period in comparison with the first embodiment.

The ink jet printer 100 of the second embodiment uses the same printer body 2 as the ink jet printer 1 of the first embodiment. Therefore, the ink jet printer 100 of the second embodiment can be used as part of the ink jet printer 1 by merely replacing the print cartridge 3 of the first embodiment with print cartridge 103 of the second embodiment.

Next, an ink jet printer 200 according to a third embodiment of the present invention will be described while referring to FIG. 9. The ink jet printer 200 includes a print cartridge 203 and ink cartridges 240, which are modifications of the print cartridge 3 and the ink cartridge 40 of the first embodiment.

The print cartridge 203 of the ink jet printer 200 is mounted with four ink cartridges 240 and two print heads 221*a*, 222*a*. Each ink cartridge 240 houses an ink package 30. In the present embodiment, each ink package 30 is filled with one of four different colored inks, that is, black ink, yellow ink, cyan ink, and magenta ink from top to bottom as viewed in FIG. 9. Although not show in the drawings, a plurality of nozzles are provided to the print heads 221, 222. The four different colored inks from the ink packages 30 are supplied to the print heads 221, 222 and ejected from the nozzles to print in full color on a print sheet PP.

More black ink than other colored inks is consumed during printing. For this reason, the ink package 30 filled with black ink needs to be replaced more frequently than the other ink packages 30. Therefore, the ink cartridge 40 housing the ink package 30 filled with black ink is mounted above the other ink cartridges 40 to facilitate operations for replacing the ink cartridge 40 filled with black ink. Also, with this configuration exchange operations can b e performed without mistaking the position for mounting the black ink cartridge 40.

The ink jet printer 200 has the same printer body 2 as the ink jet printers 1, 100 of the first and second embodiments. Therefore, by exchanging the print cartridge 203 with the print cartridges 3, 103 of the first and second embodiments, the ink jet printer 200 can be converted into either of the ink jet printers 1, 100. In other words, by merely exchanging the print cartridges 3, 103, 203, the user can easily switch between monochrome printing using the print cartridges 3, 103 and full color printing using the print cartridge 203. Further, because the user exchanges the print cartridges 3, 103, 203 to switch between monochrome printing and full color printing, different colored inks within the ink supply pathway, that is, the ink within the print head 21, the ink extraction needle 22, the ink supply tube 23, and the attachment members 24, 25, can be prevented from mixing together.

The print cartridge 203 includes four ink supply tubes 23 for connecting the ink cartridges 40 to the print heads 221*a*, 222*a*. The ink supply tubes 23 are aligned vertically one on top of the other as shown in FIG. 9. This configuration prevents the ink supply tubes 23 from bending downward, that is, as viewed in FIG. 9, under their self-weight. Accordingly, fluctuation in ink supply pressure and damage to the ink supply tubes 23 resulting from the buckling of the ink supply tubes 23 when they bend can be prevented.

Four attachment members 125*a* to 125*d* are provided, one for each of the four ink cartridges 40. As shown in FIG. 9, each attachment member 125*a* to 125*d* has an ink extraction needle 22 attached thereto at a different position in the front-to-rear direction of the printer 1. Although not shown in the drawings, the through holes 42 of the ink cartridges 40 are similarly aligned in correspondence with positions of the ink extraction needle 22. As long as the ink cartridges 40 are mounted on the print cartridge 203 in the proper order of magenta, cyan, yellow, and black, that is, starting with magenta on the bottom and ending with black on the top as viewed in FIG. 9, then each ink extraction needle 22 will be positioned at a through hole 42. On the other hand, if the ink cartridges 40 are mounted in any other order, the ink extraction needle 22 will not be positioned at a through hole 42 of the mismounted ink cartridge 40. This configuration prevents a user from accidentally mounting the wrong ink cartridge 40 and mixing ink from one ink cartridge with ink from another ink cartridge. It should be noted that the ink cartridges 40 can alternately be formed into an integral unit.

Next, while referring to FIGS. 10 to 15, an ink jet printer 300 according to a fourth embodiment of the present invention will be described. The ink jet printer 300 includes a print head mounting means and a print head separation means. It should be noted that the print head mounting means and the print head separation means are essential components of the ink jet printers of the first to third embodiments and will be explained here using the ink jet printer 300 merely as a representative example.

FIG. 10 is a plan view showing the ink jet printer 300 according to the fourth embodiment. The ink jet printer 300 includes a printer body 301 and a print cartridge 302. The printer body 301 has a main frame 301*a* formed in an approximately box shape. The print cartridge 302 has a cartridge frame 302*a* formed in a substantially box shape. The print cartridge 302 is detachably provided on the printer body 301. A rectangular shaped discharge port 303 through which printed print sheets PP are discharged is formed in the front wall of the printer body 301.

As shown in FIG. 11, the print cartridge 302 includes ink cartridges 311 disposed at a predetermined position. A print head 309 is formed with nozzles 309*a* for ejecting ink toward print sheet PP. In the ink jet printer 300 with this configuration, ink from the ink cartridges 311 is supplied to the print head 309. The print head 309 ejects the ink from the nozzles 309*a* to print on a print sheet PP.

A sheet feed port 304 through which unprinted print sheets PP are inserted is formed in the lower right side of the printer body 301. Print sheet PP inserted through the sheet feed port 304 are transported in a sheet transport direction Y indicated in FIG. 11. A transport roller 305 and a pressing roller 306 are disposed downstream from the sheet feed port 304 in the transport direction Y. The transport roller 305 for transporting print sheets PP and the pressing roller 306 for pressing the print sheets PP against the transport roller 305 cooperate together to press and support print sheets PP while transporting them.

A sheet discharge roller 307 and a pressing roller 308 are disposed downstream from the rollers 305, 306. The sheet discharge roller 307 is for discharging print sheets PP transported by the transport roller 305 out of the printer body 301. The pressing roller 308 is for pressing print sheet PP against the sheet discharge roller 307. A carriage 310 is disposed above where sheets are disposed when supported between the transport roller 305 and the sheet discharge roller 307. The print head 309 is detachably mounted on carriage 310 above where sheets are disposed when supported between the transport roller 305 and the sheet discharge roller 307.

A guide bar 313 spans between opposing sides of a frame 319 of the printer body 301. The carriage 310, on which the print head 309 is detachably mounted, is reciprocally movable along the guide bar 313 in a direction Z indicated in FIG. 12 and in a direction opposite to the direction Z. The nozzles 309*a* are formed in the print head 309 at the side thereof confronting the print sheet PP supported between the transport roller 305 and the sheet discharge roller 307. Rectangular protrusions 309*b* are provided on the upper edges of the side walls of the print head 309. As will be described later, the rectangular protrusions 309*b* are for stopping the print head 309 at a predetermined position in the print cartridge 302 when the print cartridge 302 is detached from the printer body 301.

Retaining members 314 for supporting the protrusions 309*b* are formed integrally with the print cartridge 302 at positions immediately below corresponding protrusions 309*b*. Rectangular engagement grooves 314*a*, into which the protrusions 309*b* are fitted, are formed in the upper surface of the retaining members 314 at positions in opposition with corresponding protrusions 309*b*. With this configuration, when the print cartridge 302 is lifted up and removed from the printer body 301, the retaining members 314 will be raised up so that the protrusions 309*b* of the print head 309 engage in corresponding engagement grooves 314*a*. Thus, the print head 309 is engaged with the print cartridge 302.

As will be described later, a pressing spring member 315 presses down on the print head 309 while the print head 309 is held onto the print cartridge 302 via engagement of the protrusions 309*b* in the engagement grooves 314*a* of the retaining members 314. The pressing spring member 315 insures that the print head 309 will be properly pressed down so that even if the printer cartridge 302 is dropped or otherwise subjected to a large shock, the downward pressing operation will not be accidentally released and the print head 309 will not be shifted out of position.

The four ink cartridges 311 are detachably mounted in the print cartridge 302, stacked one on top of the other. Each ink cartridge 311 is filled with a different colored ink. In the example shown in FIG. 11, the upper-most ink cartridge 311 is filled with black ink, the second one down is filled with yellow ink, the third one down is filled with cyan colored ink, and the lowest ink cartridge 311 is filled with magenta colored ink.

Four ink supply tubes 312 are provided for supplying ink to the print head 309. Each ink supply tube 312 is attached at one end to a corresponding one of the ink cartridges 311 and at the other end to the upper portion of the print head 309, which is disposed below the ink cartridge 311. Because the ink supply tubes 312 connect the print head 309 with each ink cartridge 311, ink can be supplied from the ink cartridges 311, which are disposed at predetermined positions in the print cartridge 302, to the print head 309. It should be noted that the print head 309 is mounted on the carriage 310 and moves reciprocally within the ink jet printer 300 leftward and rightward as viewed in FIG. 12.

As shown in FIG. 12, the retaining members 314 are formed in a substantial plate shape. The engagement grooves 314*a* are formed in the upper surface of the retaining members 314 in confrontation with the protrusion 309*b* of the print head 309. The engagement grooves 314*a* are formed to substantially the same depth as the thickness of the protrusion 309*b*. Further, the engagement grooves 314*a* and the protrusions 309*b* of the print head 309 are formed to the same length in the lengthwise direction of the ink jet printer 300. With this configuration, when the protrusions 309*b* are fitted in the engagement grooves 314*a*, the print head 309 is held to the print cartridge 302 and prevented from rattling around. The lengthwise ends of the protrusion members 309*b*, that is, the ends of the protrusions 309*b* that confront sidewalls of the engagement grooves 314*a*, are formed in a curved shape as best shown in FIG. 13. Therefore, when the protrusions 309*b* are fitted in the engagement grooves 314*a*, the edges of the protrusions 309*b* formed with these curve surfaces can be easily fitted in the engagement grooves 314*a*. Alternatively, the ends of the protrusions 309*b* are chamfered for the same purpose.

A carriage return motor or CR motor 320 is disposed at the upper portion of the frame 319, which is disposed at the left side of the printer body 301. The carriage return motor 320 is for supplying drive force for reciprocally moving the carriage 310 rightward in the direction Z and leftward in the direction opposite the direction Z. A line feed motor or LF motor 321 for rotating the transport roller 305 and the sheet discharge roller 307 is disposed below the carriage return motor 320.

As shown in FIG. 13, the print head 309 is formed with a rectangular shape holding groove 309*c* in its right side surface and with a substantially trapezoid shaped indentation 309*d* in its left side surface, that is, in the side surface opposite the side surface in which the holding groove 309*c* is formed. The print head 309 is further formed with two protrusion portion 309*e*, one above each of the holding groove 309*c* and the indentation 309*d*. The protrusion portions 309*e* are both formed so as to protrude outward away from the print head 309 and are positioned to abut against the upper surface of the carriage 310 as shown in FIG. 13. With this abutment, the print head 309 can be prevented from passing through and falling away from the carriage 310.

The carriage 310 is formed in a hollow box shape with the upper and lower surfaces open. The print head 309 is insertingly mounted in the open portion of the carriage 310. A holding pawl 310*a* is fixed to the right side of the carriage 310, and an approximately trapezoid shaped protrusion 310*b* is formed in the left side of the carriage 310. Both the holding pawl 310*a* and the protrusion 310*a* are for holding the print head 309 firmly onto the carriage 310 as will be described next.

The holding pawl 310*a* is formed at its upper free end portion in a substantially D shaped bend that fits in the holding groove 309*c* of the print head 309 so that the print head 309 is held firmly to the carriage 310. The holding pawl 310*a* is formed from a resilient material, such as spring steel material, and so as to be capable of resiliently deforming. Accordingly, the holding pawl 310*a* fits in and pulls out of the holding groove 309*c* of the print head 309 as the print head 309 is attached to or detached from the carriage 310. It should be noted that in order to mount the print head 309 onto the carriage 310 by resiliently deforming the holding pawl 310*a*, it is necessary to press the print head 309 onto the carriage 310 using a force of about 1 kgf, which force is sufficient to provide the resilient deformation of the holding pawl 310*a*. The protrusion 310*b* protrudes toward the interior of the carriage 310 and is formed in a shape adapted to fit into the indentation 309*d* of the print head 309.

With this configuration, the print head 309 can be fixed to the carriage 310 by fitting the protrusion 310*b* and the holding pawl 310*a* into the indentation 309*d* and the holding groove 309*c*, respectively. Because the protrusion 310*b*, and the bent upper portion of the holding pawl 310*a*, are disposed at positions confronting the carriage 310 at the same level, the protrusion 310*b* and the holding pawl 310*a* are fitted into the indentation 309*d* and the holding groove 309*c*, respectively, at almost the same time. Accordingly, the possibility of either one of the holding pawl 310*a* or the protrusion 310*b* being fitted first, that is, into the holding groove 309*c* and the indentation 309*d*, respectively, before the other can be prevented, so that the print head 309 will not be mounted at a tilting posture. There is also no danger of the user forcefully mounting the print head 309 onto the carriage 310 at the tilting posture. The printer body 301 and the print cartridge 302 are consequently more durable, and so can withstand repeated attachment and detachment of the print cartridge 302 to and from the print cartridge 302.

As shown in FIG. 13, when the print cartridge 302 is mounted on the printer body 301, the lower surface of each protrusion 309*b*, which are both disposed at the upper sides of the print head 309, will be positioned spaced away from the upper surface of corresponding engagement grooves 314*a*, which are formed in the retaining members 314 of the print cartridge 302. Therefore, during printing on the print sheet PP, the print head 309 mounted on the carriage 310 can be reciprocally moved in the left and right directions as viewed in FIG. 13 without the protrusions 309*b* catching in the engagement grooves 314*a* of the retaining members 314.

The pressing spring member 315 for pressing against the upper edge of the print head 309 is provided to the lower left side of the print cartridge 302. The pressing spring member 315 is disposed above and to the left of the print head 309. The pressing spring member 315 is a coil spring formed from a resilient material such as spring steel. The pressing spring member 315 has an abutment portion 315*b* at one end, an attachment portion 315*c* at its substantial center, and a pressing portion 315*a* at its other end. The attachment portion 315*c* is wound around a support shaft 316 formed in the print cartridge 302, so that the pressing spring member 315 is supported to the print cartridge. The abutment portion 315*b* is disposed in abutment with the inner left wall of the print cartridge 302. The pressing portion 315*a* is disposed above the print head 309. The pressing portion 315*a* and the abutment portion 315*b* are formed in combination into L-shape.

The pressing portion 315*a* is disposed so as to be swingable in the vertical direction about the support shaft 316. The pressing portion 315*a* has a substantially V shaped tip. The abutment portion 315*b* urges the pressing portion 315*a* downward so that the V shaped tip abuts against the upper end of the print head 309 and presses the print head 309 downward, thereby preventing the print head 309 from moving upward. As shown in FIG. 13, the V shaped tip of the pressing portion 315*a* is formed at a position separated by a distance L1 from an axial center of the support shaft 316.

In a manner to be described later, it is necessary to press the print head 309 into the carriage 310 with pressing force of about 1 kgf in order to mount the print head 309 onto the carriage 310. Therefore, the pressing spring member 315 is formed to press the upper surface of the print head 309 downward with a pressing force of more than 1 kgf.

A rectangular shaped guide member 318 is formed on the print cartridge 302. A link member 317 formed in a substantially rod shape is slidably mounted in the guide member 318. The link member 317 is disposed below the pressing spring member 315 and is for pressing the pressing spring member 315 upward in a manner to be described below. A rectangular shaped pressed portion 317*a* is fixed to the lower tip of the link member 317. A stop portion 317*b* for preventing the link member 317 from falling out of the guide member 318 is fixed to the link member 317 at a position above the guide member 318. Therefore, the downward travel can be stopped by the abutment of the stop portion 317*b* against the top surface of the guide member 318.

The plate shaped frame 319 is provided to the printer body 301 at a position directly below the pressed portion 317*a* of the link member 317. A link pressing portion 319a for pressing the link member 317 upward is integrally formed with the frame 319 and extends upward from the upper edge of the frame 319. With this configuration, there is no need to provide the printer body 301 with a separate member for pressing the link member 317 upward, so the ink jet printer 300 can be produced using fewer parts.

The link member 317 is disposed at a position so that its upper tip abuts the lower surface of the pressing portion 315*a* at a position near the attachment portion 315*c*. More specifically, the link member 317 is positioned by the guide member 318 so that the upper tip of the link member 317 abuts against and presses the pressing spring member 315 upward at a position separated by a distance L2 from the axial center of the support shaft 316, wherein the distance L2 is smaller than the distance L1. Accordingly, the link member 317 abuts the pressing portion 315*a* at a position nearer to the attachment portion 315*c* than where the pressing portion 315*a* abuts against the print head 309. Therefore, the pressing portion 315*a* can be lowered downward greatly by moving the link member 317 downward only by a slight amount. The amount that the pressing portion 315*a* is raised and lowered can be made much greater than the amount that the link member 317 is raised and lowered. Accordingly, by moving the link member 317 only slightly with respect to the pressing spring member 315, the pressing portion 315*a* can be swung greatly in the vertical direction.

In the ink jet printer 300 of the fourth embodiment, the guide member 318 is positioned so that the L2 is about one third of the distance L1. Accordingly, when the upper tip of the link member 317 presses the pressing spring member 315 upward by about 3 mm, the pressing portion 315*a* can be pressed upward by three times that amount, or by 9 mm. Accordingly, the pressing spring member 315 can be prevented from abutting against the print head 309 and obstructing movement of the print head 309 while the print head 309 is mounted on the carriage 310 and printing is performed by reciprocally moving the print head 309 in the direction Z and in the direction opposite the direction Z.

Next, while referring to FIG. 14, operations for removing the print cartridge 302 from the printer body 301 will be described. FIG. 14 is a cross-sectional view similar to FIG. 13, showing the print cartridge slightly detached from the printer body 301 so that the pressing spring member 315 presses against the print head 309 mounted on the carriage 310. As shown in FIG. 14, to detach the print cartridge 302 from the printer body 301, first, the print cartridge 302 is lifted up slightly away from the printer body 301. That is, the print cartridge 302 shown in FIG. 13 is lifted and moved upward to the position shown for the print cartridge 302 in FIG. 14. When the print cartridge 302 is moved slightly upward, the retaining members 314 move upward with the print cartridge 302 so that the protrusions 309*b* fit into the engagement grooves 314*a*. Simultaneously with this, slight upward movement of the print cartridge 302 is translated into slight downward movement of the link member 317. Therefore, the pressing portion 315*a* moves downward and abuts against the upper surface of the print head 309 so that the print head 309 is pressed downward.

Because the link member 317 abuts the pressing portion 315*a* at a position closer to the attachment portion 315*c* than where the pressing portion 315*a* abuts against the print head 309, the slight downward movement of the link member 317 is translated into a large downward movement of the pressing portion 315*a*. Therefore, by merely lifting the print cartridge 302 slightly upward, the pressing spring member 315 will rapidly press against the print head 309 so that when the print cartridge 302 is removed, the print head 309 can be prevented from moving out of place.

When the print cartridge 302 is further lifted upward, the print head 309 will also be lifted upward. When the print head 309 is lifted upward, the holding pawl 310*a* deforms and separates from the holding groove 309*c*. Simultaneously, the protrusion 310*b* of the carriage 310 separates from the indentation 309*d* of the print head 309. As a result, the print head 309 separates from the carriage 310 in association with separation of the printer cartridge 302 from the printer body 301.

When the print head 309 separates from the carriage 310 and the print cartridge 302 separates from the printer body 301, the pressed portion 317*a* of the link member 317 separates from the link pressing portion 319*a* of the frame 319. When the pressed portion 317*a* separates from the upper tip of the link pressing portion 319*a*, the link member 317 further slides downward via the guide member 318. As a result, the upper tip of the link member 317 separates from the pressing spring member 315 so that the pressing spring member 315 completely presses against the print head 309. At this time, the print head 309 is pressed down while in the left side portion of the print cartridge 302.

Next, while referring to FIGS. 14 and 15, operations to mount the print cartridge 302 onto the printer body 301 will be described. The operations for mounting the print cartridge 302 onto the printer body 301 are performed using the opposite order of operations for separating the print cartridge 302 from the printer body 301. As shown in FIG. 15, the print cartridge 302 is first aligned above the printer body 301 with the print head 309 in opposition with the carriage 310.

After the print cartridge 302 is positioned in this manner, the print head 309 is inserted into the carriage 310. At this time, the print head 309 is pressed downward by the pressing spring member 315. The printhead 309 is inserted into the carriage 310 until the holding pawl 310*a* and the protrusion 310*b* of the carriage 310 are fitted in the holding groove 309*c* and the indentation 309*d*, respectively, of the print head 309 and until both of the protrusion portions 309*e* of the print head 309 abut against the upper surface of the carriage 310. In this way, the print head 309 is mounted on the carriage 310 as shown in FIG. 14 in association with mounting of the print cartridge 302 onto the printer body 301.

As mentioned above, the print head 309 must be pressed downward with a pressing force of about 1 kgf when inserted into the carriage 310 so as to deform the holding pawl 310*a*. Since print head 309 is pressed downward by the pressing spring member 315 by a force of more than 1 kgf, the print head 309 can be easily pressed into the print head 309.

As shown in FIG. 14, the pressed portion 317*a* is brought into abutment with the link pressing portion 319*a* simultaneously with mounting of the print head 309 onto the carriage 310. As a result, the link member 317 is pressed and slidingly moved upward by the link pressing portion 319*a* relative to the guide member 318. When the link member 317 is pressed upward, the upper tip of the link member 317 abuts against the pressing spring member 315 and the link member 317 starts to press the pressing portion 315*a* upward. Afterward, when the print cartridge 302 is further pressed onto the print cartridge 302 so that the print cartridge 302 slightly moves downward, the link pressing portion 319*a* further presses the link member 317 slightly upward so that the link member 317 presses the pressing portion 315*a* upward away from the print head 309.

Because the link member 317 abuts against the pressing portion 315*a* at a position nearer the attachment portion 315*c* than where the pressing portion 315*a* abuts against the print head 309, the slight upward movement of the link member 317 translates into a large upward movement of the pressing portion 315*a*. That is to say, the upward movement amount of the pressing portion 315*a* is much greater than the upward movement amount of the link member 317. Therefore, by pressing the print cartridge 302 slightly downward onto the print cartridge 302, the pressing portion 315*a* can be reliably pressed upward away from the print head 309. It should be noted that according to the present embodiment, when the link pressing portion 319*a* presses the link member 317 upward by about 3 mm, the pressing portion 315*a* will be pressed upward by about 9 mm.

When the print cartridge 302 moves further downward, the link member 317 presses the pressing portion 315*a* further upward away from the print head 309. Also, the retaining members 314 move downward with movement of the print cartridge 302. As a result, the protrusions 309*b* is moved upward relative to the engagement grooves 314*a* so that the protrusions 309*b* separate from the engagement grooves 314*a*. By the time the protrusions 309*b* separate from the engagement grooves 314*a*, the pressing spring member 315 has stopped pressing against the print head 309. This completes operations for mounting the print cartridge 302 onto the printer body 301.

When the print cartridge 302 is mounted in this manner, the ink jet printer 300 is capable of printing on a print sheet PP. That is to say, when an unused print sheet PP is inserted into the sheet feed port 304, the line feed motor 321 rotates to drive rotation of the transport roller 305 and the pressing roller 306, thereby transporting the unused print sheet PP to below the print head 309. When the print sheet PP transported in this manner passes below the print head 309, the carriage 310 is driven by the carriage return motor 320 and ink is ejected from the nozzles 309*a* formed in the print head 309 mounted on the carriage 310 so that printing is performed on the print sheet PP. The printed print sheet PP is then discharged through the discharge port 303 by rotation of the sheet discharge roller 307 and the pressing roller 308, which are driven by rotation of the line feed motor 321. It should be noted that the ink filling the ink cartridge 311 is supplied to the print head 309 through the ink supply tube 312 and ejected from the nozzles 309*a* of the print head 309.

According to the ink jet printer 300 of the fourth embodiment, the protrusions 309*b* and the engagement grooves 314*a* hold the print head 309, which is capable of reciprocal movement within the ink jet printer 300 in association with movement of the carriage 310, at a predetermined position in the print cartridge 302 when the print cartridge 302 is separated from the printer body 301. Also, the pressing spring member 315 presses the print head 309 at a predetermined position of the print cartridge 302. Accordingly, the print cartridge 302 can be detached from the printer body 301 and carried around without the print head 309 moving around in the print cartridge 302. Further, the print head 309 can be attached to and detached from the carriage 310 in association with the attachment and detachment of the print cartridge 302 to and from the printer body 301.

Because the print head 309 is pressed and held in place at a predetermined position of the print cartridge 302 when the print cartridge 302 is mounted on the printer body 301 and the print head 309 is mounted on the carriage 310, there is no need for the user to grasp the print head 309 by hand and move it to a predetermined position. Therefore, the user can avoid staining his or her hands. printer body 301 so that the print head 309 is mounted on the carriage 310, the link member 317 and the link pressing portion 319*a* prevent the pressing spring member 315 from pressing against the print head 309. Accordingly, the pressing spring member 315 will not interfere with movement of the print head 309. Therefore, the print head 309 mounted on the carriage 310 can reciprocally move within the ink jet printer 300 without interference.

While the invention has been described in detail with reference to specific embodiments thereof, it would be apparent to those skilled in the art that various changes and modifications may be made therein without departing from the spirit and scope of the invention.

In the forgoing embodiments, the entire ink package 30 was formed from a laminated film and the ink extraction needle 22 was inserted into the indentation portion 32 to extract ink. However, different configurations can be provided for performing extraction of ink. For example, ink can be sealed directly into the ink cartridge itself without using the ink package 30. In this case, a laminated film to be pierced by the ink extraction needle 22 can be fused onto a portion of the ink cartridge. During use, the laminated film member is pierced by the ink extraction needle 22 and ink is extracted from the ink cartridge. It should be noted that in this case, the ink cartridge can be formed from a polyoxymethylene (POM) or other material that can, without undesirable results, come into contact with ink used in printing. In other words, the cartridge should be formed of a material compatible with the ink.

The third embodiment describes that the ink extraction needles 22 are attached at different positions with respect to the front and rear direction of FIG. 9 and that the through hole 42 are formed at positions corresponding to the ink extraction needles 22. However, the positions of the ink extraction needle 22 and the through hole 42 are not restricted to this configuration. For example, ink extraction needles can be disposed at the same position with respect to the front and rear direction of FIG. 9. That is, ink extraction needles can be disposed in a vertically aligned arrangement. In this case, the through holes are formed at about the same position in their respective ink cartridges so that the same cartridge body can be used for all different colored inks. In this case, the number of different types of print cartridge 203 can be reduced.

The third embodiment describes use of a plurality of separate ink cartridges 40. However, a plurality of ink cartridges can be formed in an integral unit. In this case, by providing a partition member between adjacent ink packages housed in the integral ink cartridge, the ink packages can be prevented from directly contacting each other. Accordingly, there is no danger that contact between the ink packages will change internal pressure within the ink sealed portions.

Regarding all embodiments, the link pressing portion 319*a* is provided at the upper surface of the frame 319 for pressing the link member 317 upward. However, other configurations can be provided for pressing the link member 317 upward. For example, a separate pressing member for pressing the link member upward can be provided to the printer body. In other words, any kind of arrangement is available as long as the link member can press the spring member 315 upward above the print head when the printer cartridge is mounted on the printer body.

In the foregoing embodiments, the holding pawl 310*a* and the trapezoid shaped protrusion 310*b* are provided to the carriage 310, and the holding groove 309*c* and the trapezoid shaped indentation 309*d* are formed in the print head 309. However, the holding pawl and the trapezoid shaped protrusion can be provided to the print head and the holding groove an the trapezoid shaped indentation can be formed in the carriage.

What is claimed is:

1. An image forming device for forming an image on a print sheet comprising:

a printer body;

a cartridge unit detachably provided to the printer body;

a print head that impinges a colored agent onto the print sheet to print on the print sheet, the print head being slidably movably disposed in the cartridge unit;

a colored agent supply means that supplies said colored agent to the print head, the supply means being disposed at a fixed position in the cartridge unit;

a carriage provided in the printer body and reciprocally movable therein, the print head being detachably mounted on the carriage and being movable in accordance with the reciprocal movement of the carriage;

driving means disposed in the printer body and driving the carriage; and assisting means that assists mounting of the print head onto the carriage in interlocking relation with mounting of the cartridge unit onto the printer body.

2. The image forming device as claimed in claim 1, wherein the assisting means comprises:

a pressure member movable between a pressure applying region and a pressure release region with respect to the print head, the pressure member initially pressing the print head in the pressure applying region when the print head is mounted on the carriage, and releasing the pressure to the print head when the mounting of the print head onto the carriage is completed in the pressure release region, the pressure member also applying pressure to the print head in the pressure applying region after the print head is removed from the carriage; and a release member that allows the pressure member to move toward the pressure applying region when mounting of the cartridge unit onto the printer body is incomplete or when the cartridge unit is separated from the printer body, and the release member moving the pressure member toward the pressure release region when the cartridge unit is completely mounted on the printer body.

3. The image forming device as claimed in claim 2, wherein the cartridge unit is positioned above the printer body when the cartridge unit is mounted on the printer body, so that the cartridge unit is attached to and detached from the printer body by moving the cartridge unit in a vertical direction.

4. The image forming device as claimed in claim 3, wherein the pressure member comprises:

an elongated pressing portion swingable in a vertical direction toward the pressure applying region and a pressure release region;

an urging portion that urges the elongated pressing portion toward the pressure applying region; and an attachment portion that attaches the elongated pressing portion and the urging portion to the cartridge unit;

and wherein the release member comprises:

a link member movable in said vertical direction and supported to the cartridge unit, the link member having an upper end abuttable on the pressing portion for pressing the pressure portion against a biasing force from the urging portion, the link member having a lower end; and a support member provided in the printer body, the lower end of the link member being abutted against the support member to move the link member upwardly when the cartridge unit is mounted on the printer body, whereby the pressure portion is moved upward away from the print head.

5. The image forming device as claimed in claim 4, wherein the link member is disposed adjacent the attachment portion of the pressing member, the pressing portion having a free end portion selectively contactable with the print head, a first distance between the free end portion and the attachment portion being greater than a second distance between the attachment portion and the upper end of the link member when the upper end of the link member is in contact with the pressing portion.

6. The image forming device as claimed in claim 5, wherein the printer body comprises a frame body having opposing side walls;

and the image forming device further comprising a guide bar extending between the opposing side walls for guiding reciprocal movement of the carriage, the support member being provided on the frame body.

7. The image forming device as claimed in claim 2, further comprising a fixing means for fixing the print head at a fixed position in the carriage, the fixing means comprising a holding pawl formed from a resilient material provided at one of the print head and carriage, remaining one of the carriage and the print head being formed with a holding groove at a complementary position of the holding pawl for holding the holding pawl.

8. The image forming device as claimed in claim 7, wherein the fixing means further comprises:

a holding protrusion disposed at a position substantially opposite from the holding pawl and provided at one of the print head and carriage, remaining one of the carriage and the print head being formed with a holding indentation at a complementary position of the holding protrusion for holding the holding protrusion, the holding pawl and the holding protrusion engaging the holding groove and the holding indentation, respectively, at a vertical level equal to each other.

9. The image forming device as claimed in claim 1, wherein the colored agent supply means comprises:

a colored agent cartridge unit filled with said colored agent and disposed at a fixed position on the cartridge unit; and colored agent transport means connected between the colored agent cartridge unit and the print head for transporting said colored agent from the colored agent cartridge unit to the print head.

10. The image forming device as claimed in claim 9, wherein the colored agent cartridge unit is detachably mounted to the cartridge unit.

11. An image forming device for forming an image on a print sheet comprising:

a printer body;

a cartridge unit detachably provided to the printer body;

a print head that impinges a colored agent onto the print sheet to print on the print sheet, the print head being slidably movably disposed in the cartridge unit;

a colored agent supply means that supplies said colored agent to the print head, the supply means being disposed at a fixed position in the cartridge unit;

a carriage provided in the printer body and reciprocally movable therein, the print head being detachably mounted on the carriage, and being movable in accordance with the reciprocal movement of the carriage;

driving means disposed in the printer body and driving the carriage; and a print head detachment means for detaching the print head from the carriage in interlocking relation with detachment of the cartridge unit from the printer body.

12. The image forming device as claimed in claim 11, wherein the cartridge unit is positioned above the printer body when the cartridge unit is mounted on the printer body, so that the cartridge unit is attached to and detach from the printer body by moving the cartridge unit in a vertical direction, and wherein the print head detachment means comprises:

a protrusion member protruding outward away from the print head; and a retaining member provided to the cartridge unit and formed with an engagement groove with which the protrusion member is engageable, the engagement groove being positioned lower than the protrusion member, so that the protrusion member is trapped by the engagement groove when the cartridge unit is moved upwardly from the printer body.

13. The image forming device as claimed in claim 12, wherein the protrusion member has lateral side ends each formed with a curved or beveled surface;

and wherein the engagement groove has opposing vertical surfaces in confronting relation to the curved or beveled surface when the protrusion member is brought into engagement with the engagement groove.

14. The image forming device as claimed in claim 13, wherein a distance between the lateral side ends of the protrusion member is equal to a distance between the opposing vertical surfaces of the engagement groove.

15. The image forming device as claimed in claim 11, wherein the colored agent supply means comprises:

a colored agent cartridge unit filled with said colored agent and disposed at a fixed position on the cartridge unit; and colored agent transport means connected between the colored agent cartridge unit and the print head for transporting said colored agent from the colored agent cartridge unit to the print head.

16. The image forming device as claimed in claim 15, wherein the colored agent cartridge unit is detachably mounted to the cartridge unit.

17. An image forming device for forming an image on a print sheet comprising:

a printer body;

a cartridge unit detachably provided to the printer body;

a print head that impinges a colored agent onto the print sheet to print on the print sheet, the print head being slidably movably disposed in the cartridge unit;

a colored agent supply means that supplies said colored agent to the print head, the supply means being disposed at a fixed position in the cartridge unit;

a carriage provided in the printer body and reciprocally movable therein, the print head being detachably mounted on the carriage and being movable in accordance with the reciprocal movement of the carriage;

driving means disposed in the printer body and driving the carriage;

assisting means that assists mounting of the print head onto the carriage in interlocking relation with mounting of the cartridge unit onto the printer body; and a print head detachment means for detaching the print head from the carriage in interlocking relation with detachment of the cartridge unit from the printer body.

18. The image forming device as claimed in claim 17, wherein the assisting means comprises:

a pressure member movable between a pressure applying region and a pressure release region with respect to the print head, the pressure member initially pressing the print head in the pressure applying region when the print head is mounted on the carriage, and releasing the pressure to the print head when the mounting of the print head onto the carriage is completed in the pressure release region, the pressure member also applying pressure to the print head in the pressure applying region after the print head is removed from the carriage; and a release member that allows the pressure member to move toward the pressure applying region when mounting of the cartridge unit onto the printer body is incomplete or when the cartridge unit is separated from the printer body, and the release member moving the pressure member toward the pressure release region when the cartridge unit is completely mounted on the printer body.

19. The image forming device as claimed in claim 18, wherein the cartridge unit is positioned above the printer body when the cartridge unit is mounted on the printer body, so that the cartridge unit is attached to and detach from the printer body by moving the cartridge unit in a vertical direction.

20. The image forming device as claimed in claim 19, wherein the pressure member comprises:

an elongated pressing portion swingable in a vertical direction toward the pressure applying region and a pressure release region;

an urging portion that urges the elongated pressing portion toward the pressure applying region; and an attachment portion that attaches the elongated pressing portion and the urging portion to the cartridge unit;

and wherein the release member comprises:

a link member movable in said vertical direction and supported to the cartridge unit, the link member having an upper end abuttable on the pressing portion for pressing the pressure portion against a biasing force from the urging portion, the link member having a lower end; and a support member provided in the printer body, the lower end of the link member being abutted against the support member to move the link member upwardly when the cartridge unit is mounted on the printer body.

21. The image forming device as claimed in claim 20, wherein the link member is disposed adjacent the attachment portion of the pressing member, the pressing portion having a free end portion selectively contactable with the print head, a first distance between the free end portion and the attachment portion being greater than a second distance between the attachment portion and the upper end of the link member when the upper end of the link member is in contact with the pressing portion.

22. The image forming device as claimed in claim 21, wherein the printer body comprises a frame body having opposing side walls;

and the image forming device further comprising a guide bar extending between the opposing side walls for guiding reciprocal movement of the carriage, the support member being provided on the frame body.

23. The image forming device as claimed in claim 18, further comprising a fixing means for fixing the print head at a fixed position in the carriage, the fixing means comprising a holding pawl formed from a resilient material provided at one of the print head and carriage, remaining one of the carriage and the print head being formed with a holding groove at a complementary position of the holding pawl for holding the holding pawl.

24. The image forming device as claimed in claim 23, wherein the fixing means further comprises:

a holding protrusion disposed at a position substantially opposite from the holding pawl and provided at one of the print head and carriage, remaining one of the carriage and the print head being formed with a holding indentation at a complementary position of the holding protrusion for holding the holding protrusion, the holding pawl and the holding protrusion engaging the holding groove and the holding indentation, respectively at a vertical level equal to each other.

25. The image forming device as claimed in claim 20, wherein the print head detachment means comprises:

a protrusion member protruding outward away from the print head; and a retaining member provided to the cartridge unit and formed with an engagement groove with which the protrusion member is engageable, the engagement groove being positioned lower than the protrusion member, so that the protrusion member is trapped by the engagement groove when the cartridge unit is moved upwardly from the printer body, the print head being firmly fixed to the cartridge unit by the engagement between the protrusion member and the engagement groove and by the pressing of the pressing portion of the pressing member onto the print head.

26. The image forming device as claimed in claim 25, wherein the protrusion member has lateral side ends each formed with a curved or beveled surface;

and wherein the engagement groove has opposing vertical surfaces in confronting relation to the curved or beveled surface when the protrusion member is brought into engagement with the engagement groove.

27. The image forming device as claimed in claim 26, wherein a distance between the lateral side ends of the protrusion member is equal to a distance between the opposing side surfaces of the engagement groove.

28. A cartridge unit for use in combination with an image forming device, the image forming device having a printer body and a carriage reciprocally movably disposed therein, the cartridge unit comprising:

a cartridge case detachably mountable to the printer body;

a print head that impinges a colored agent onto a print sheet to print on the print sheet, the print head being detachably mountable to the carriage and reciprocally movable in the cartridge case;

colored agent supply means that supplies said colored agent to the print head, the colored agent supply means being disposed at a predetermined position on the cartridge case; and, assisting means that assist mounting of the print head onto the carriage in interlocking relation with mounting of the cartridge case onto the printer body.

29. A cartridge unit for use in combination with an image forming device, the image forming device having a printer body and a carriage reciprocally movably disposed therein, the cartridge unit comprising:

a cartridge case detachably mountable to the printer body;

a print head that impinges a colored agent onto a print sheet to print on the print sheet, the print head being detachably mountable to the carriage and reciprocally movable in the cartridge case;

colored agent supply means that supplies said colored agent to the print head, the colored agent supply means being disposed at a predetermined position on the cartridge case; and, a print head detachment means for detaching the print head from the carriage in interlocking relation with detachment of the cartridge case from the printer body.

30. A cartridge unit for use in combination with an image forming device, the image forming device having a printer body and a carriage reciprocally movably disposed therein, the cartridge unit comprising:

a cartridge case detachably mountable to the printer body;

a print head that impinges a colored agent onto a print sheet to print on the print sheet, the print head being detachably mountable to the carriage and reciprocally movable in the cartridge case;

colored agent supply means that supplies said colored agent to the print head, the colored agent supply means being disposed at a predetermined position on the cartridge case;

assisting means that assist mounting of the print head onto the carriage in interlocking relation with mounting of the cartridge unit onto the printer body; and, a print head detachment means for detaching the print head from the carriage in interlocking relation with detachment of the cartridge case from the printer body.

* * * * *